US005253030A

United States Patent [19]

Shigemura et al.

[11] Patent Number: 5,253,030

[45] Date of Patent: Oct. 12, 1993

[54] IMAGE FORMING APPARATUS

[75] Inventors: Yutaka Shigemura, Takarazuka; Takashi Kondo, Sakai; Hideo Umezawa, Amagasaki; Junichi Oura, Hirakata; Mitsuharu Yoshimoto, Kitakatsuragi; Satoshi Yano, Takatsuki; Yukihiro Ito, Osaka; Yoshifumi Okauchi, Sakai; Yoshitake Miyoshi, Soraku; Takashi Miyake, Hirakata; Kiyoshi Hayashi, Takatsuki, all of Japan

[73] Assignee: Mita Industrial Co., Ltd., Osaka, Japan

[21] Appl. No.: 553,378

[22] Filed: Jul. 17, 1990

[30] Foreign Application Priority Data

| | | | |
|---|---|---|---|
| Jul. 18, 1989 | [JP] | Japan | 1-185610 |
| Jul. 18, 1989 | [JP] | Japan | 1-185611 |
| Jul. 18, 1989 | [JP] | Japan | 1-185612 |
| Aug. 12, 1989 | [JP] | Japan | 1-208605 |
| Nov. 16, 1989 | [JP] | Japan | 1-298594 |
| Mar. 20, 1990 | [JP] | Japan | 2-71045 |

[51] Int. Cl.[5] ..... G03G 21/00; G03G 15/00

[52] U.S. Cl. ..... 355/324; 83/167; 83/622; 83/628

[58] Field of Search ..... 355/200, 202, 321, 322, 355/323, 324, 310; 83/167, 620, 622, 628

[56] References Cited

U.S. PATENT DOCUMENTS

| | | | |
|---|---|---|---|
| 2,327,646 | 8/1943 | Hutchinson | 83/628 X |
| 2,405,150 | 8/1946 | Kern | 83/628 X |
| 3,987,695 | 10/1976 | Neilsen | 83/628 X |
| 4,160,396 | 7/1979 | Matzner et al. | 83/100 |
| 4,424,963 | 1/1984 | Bartholet et al. | 270/53 |
| 4,445,409 | 5/1984 | Mohr et al. | 83/157 |
| 4,847,656 | 7/1989 | Kuno et al. | 355/202 |
| 4,988,085 | 1/1991 | Maekawa et al. | 270/53 |
| 5,021,837 | 6/1991 | Uto et al. | 355/322 |

FOREIGN PATENT DOCUMENTS

| | | |
|---|---|---|
| 0056874 | 8/1982 | European Pat. Off. . |
| 0318754 | 6/1989 | European Pat. Off. . |
| 58-140755 | 8/1983 | Japan . |
| 60-168163 | 8/1985 | Japan . |
| 60-260965 | 12/1985 | Japan . |
| 62-31659 | 2/1987 | Japan . |
| 63-121862 | 5/1988 | Japan . |
| 64-34862 | 2/1989 | Japan . |
| 2-48365 | 2/1990 | Japan . |

*Primary Examiner*—Fred L. Braun

*Attorney, Agent, or Firm*—Antonelli, Terry, Stout & Kraus

[57] ABSTRACT

Near a discharge device (48) for discharging paper (P) with an image formed thereon, there is provided a punch (7) for punching holes. The drive of the discharge device (48) is controlled so that the punch punches the punch holes in the trailing portion of the paper (P), without causing creasing or tearing or change in the quality of the paper (P). The punch (7) includes punching cutters (72) and a punching die (74). The punching cutters (72) and the punching die (74) are provided in a unit (U) which can be drawn out of a casing (1) covering the punch (7). With the unit (U) drawn out of the casing (1), jam recovery can be easily executed. The unit (U) is movable in the width direction of the paper (P), thereby making it possible to adjust the position of punched holes. A collecting box (76) for collecting paper scraps (P1) is disposed in the unit (U). If the collecting box (76) is pivoted or the opening (76*a*) thereof is lifted up when the unit (U) is pivoted, the paper scraps (P1) therein will not fall out. Delaying timing for plural punching cutters (72) to punch holes can reduce the load on the drive system.

53 Claims, 33 Drawing Sheets

IMAGE FORMING APPARATUS

BACKGROUND OF THE INVENTION

The present invention relates to an image forming apparatus applying an electrophotographic process, such as an electrostatic copying apparatus or a laser beam printer. More specifically, the present invention relates to an image forming apparatus provided with a punching function for punching holes to file a paper whereon an image has been formed.

As an apparatus for forming an electrophotostatic lament image on the surface of a copy paper by means of the an electrophotographic process, there have been proposed a variety of types which includes a punching function geared with the operations of the apparatus to automatically punch holes for filing of the paper. In an electrophotographic process, a copy paper is processed by producing an electrostatic latent image formed on the surface of a photosensitive material and by transferring the image to the copy paper, and the image processing is followed by fusing the transferred image by heating and such.

Existing image forming apparatuses having a punching function are roughly divided into two types; one type punches holes in the copy paper in advance of the image processing, and another type punches holes after the image processing and fusing. In the former type, paper crumbs made by punching may adversely affect formation of the image. Accordingly, the latter type apparatus, wherein holes are punched after the image processing and fusing, has become increasingly popular.

The image forming apparatus generally employs a punching means provided with punching cutters movable along a paper delivery passage and with a punching die, for introducing the punching cutters, which is disposed in the delivery passage, opposing the punching cutter. When the punching means punches holes in the paper, the paper needs to be temporarily halted in the paper delivery means. According to the conventional methods of temporarily halting the paper, the leading edge of the paper is adapted to hit a stopper or a discharge roller for carrying the paper out of the apparatus and is temporarily stopped.

However, the apparatus of the above-mentioned composition may cause a crease or fold on the paper, if the paper is halted with the trailing portion thereof caught in a constantly rotating discharge roller which is disposed in a discharge passage. In addition, if the paper is halted with the trailing portion thereof caught in a fusing unit for heating and fusing a transferred image on the paper, the portion caught in the fusing unit may be excessively heated, resulting in a charge in the quality of the paper.

To prevent the creasing and folding of the paper, and changing the quality of the paper with heating, there has been proposed image forming apparatuses, wherein a punching function H for punching holes is disposed near a paper discharge port Y1 in the paper delivery means Y, and a halting portion for halting paper P in a curved condition, as shown by the dot-and-dash line in FIG. 37, is provided between the punching function H and the always constantly rotating delivery roller Y2 (described in JP, A-140755/1983).

The punching function H includes;

a punching means X comprising punching cutters X1 and a punching die X2 having through-holes X2*a* for receiving the punching cutters;

a stopper H1 for the leading edge of the paper P to hit;

and a discharge roller H2 which stops rotating when the punching means X punches holes. In the punching function H of FIG. 37, a sensor; H3 detects the leading edge of the paper P, extends the stopper H1 as illustrated by the black arrow in FIG. 37, stops the rotation of the discharge roller H2. Cams X3 rotate on a rotary shaft X3*a* to move the punching cutters X1 up and down.

According to the above mentioned image forming apparatus, if the paper P is so large that the paper P is halted by the stopper H1 and the discharge roller H2 while the trailing portion of the paper is in the delivery roller Y2, the delivery roller Y2 keeps rotating to push forward the trailing portion of the paper P to curve it as illustrated with the dot-and-dash line in FIG. 37. Since the paper P is halted in the halting portion Z in this manner, creasing or folding of on the paper P can be prevented.

For preventing creasing or folding of on the paper halted in the halting portion Z, the paper should be gently curved as shown in FIG. 37. This requires a large space for the halting portion Z in the vertical and in the delivery passage directions. Accordingly it is impossible to miniaturize the image forming apparatus.

When, paper crumbs caught in the punch lock the punching cutter X1 the punching cutter X1 cannot withdraw, and this causes paper to jam therein. Likewise, a paper jam in other parts of the apparatus may stop the image forming apparatus with the punching cutter X1 pushed down by the cam X3. In these situations a jam recovery process should be easily executed in a conventional image forming apparatus having a punching function. To meet this need, there has been proposed an image forming apparatus provided with a punching means X, wherein, as shown in FIG. 38, a punching die X2, also serving as a guide plate for the bottom side of a paper delivery means Y, can be turned downward to open the paper delivery means Y (described in JP-U, A-193698/1988).

The above-mentioned structure, however, requires a space large enough to turn the punching die X2 open for executing jam recovery under the punching means X, and therefore it is difficult to miniaturize the apparatus. Furthermore, the jam recovery operation is difficult, because a user must remove the jam while looking up into the paper delivery means Y, which is far below the eye-level of the user.

In addition, when paper crumbs are caught between the punching cutters X1 and the through-hole X2*a* in the punching die X2, and it is difficult to open the punching die X2, the jam recovery is more troublesome.

Every image forming apparatus should punch holes at the same position in the paper. But in fact, every apparatus punches holes at any position which may be shifted in the width direction of the paper. The shift stems from, for instance, very close assembly tolerances in manufacturing the image forming apparatus.

As shown in FIG. 39, an image forming apparatus with a punching function normally has a collecting box K to collect paper scraps left after punching holes, the box being disposed beneath the punching die X2 in the punching means X. To remove the paper scraps left after the punching, however, the user must take the trouble to open the main body of the apparatus and to remove the scraps.

To facilitate the removal of the paper scraps, it is suggested to dispose the collecting box K at the upper side of a unit, which turns or moves parallel in one piece, thereby to draw the box out of the main body of the apparatus.

However, in the structure wherein the unit moves to be drawn out, it is not easy to take out the collecting box, because the collecting box K is further under the punching means which is far below the eye-level of the user.

On the other hand, in the structure wherein the box is turned around a shaft disposed under the unit, the collecting box K can be easily taken out because the box is exposed on the upper side of the unit. However, the paper scraps in the box may fall off because the box turns along with turning the unit.

It is normally required to punch two or more holes at regular interval in the width direction of the paper which is carried in the paper delivery means. As shown in FIG. 40 and 41, cams X3 connected to a driving source (not shown) of the image forming apparatus rotate on a rotary shaft X3*a*, vertically moving a plurality of punching cutters X1 (two cutters shown in FIG. 41). Thus, the cutters punch two or more holes at a time (described in JP, A-260965/1985).

As described above, the punching means X punches two or more holes at a time by using the punching cutters X1, and therefore a great amount of load is applied on the driving source when punching holes. This may affect driving of the other parts of the image forming apparatus. Consequently, if an image forming process is executed on another sheet of paper when the holes are punched, a deviated image may be formed.

When the holes are punched in hard paper such as cardboard in particular, there may occur troubles such as disengagement of a pulley from a timing belt used as a transmission function to transmit the driving force from the driving source to the rotary shaft X3*a* of cams X3, breakage of the gear used for the transmission function, or bending of the rotary shaft X3*a*. Hence, it is required to make the transmission function components or the rotary shaft X3*a* with materials of higher rigidity, or to reinforce the rotary shaft X3*a* by increasing the thickness thereof. This results in higher production costs or in larger and heavier punching means.

SUMMARY OF THE INVENTION

A primary object of the present invention is to provide an image forming apparatus which does not cause creasing or folding of on paper or change in quality with heating, and which does not require a large space, enabling miniaturization.

A further object of the invention is to provide an image forming apparatus, which facilitates jam recovery and which does not need a large space for executing a jam recovery, enabling miniaturization.

A still further object of the invention is to provide an image forming apparatus, which facilitates the removal of paper scraps left after punching holes and which does not let the scraps fall off.

Another object of the invention is to provide an image forming apparatus which can precisely adjust a punch-hole position in paper in the width direction of the paper.

A still another object of the invention is to provide an image forming apparatus which does not affect driving of an image forming apparatus with less load on the driving system of the apparatus such as a driving source or a transmission function, and which can reduce manufacturing costs and can be made smaller and less heavy.

The present invention provides an image forming apparatus comprising;

a paper delivery means for carrying paper whereon an image has been formed out of the apparatus;

detecting means for detecting the leading or the trailing portion of the paper delivered by the paper delivery means;

a punching means for punching holes in the paper, being disposed near the discharge means for discharging paper, this means which is included in the paper delivery means; and drive control means for controlling the drive of the discharge means, so that according to a signal from the detecting means, the paper being carried by the discharge means is halted with the trailing portion thereof placed in the punching means, has the punching means punch holes in the trailing portion thereof, and then is carried out of the apparatus.

Another embodiment of the invention provides an image forming apparatus provided with the paper delivery means and the punching means; wherein the punching means includes a plurality of punching cutters disposed at a predetermined interval in the width direction of the paper carried with the paper delivery means, a punching die for receiving these punching cutters, and pushing means to project the punching cutters toward the punching die;

the pushing means is supported in a casing covering the punching means; and the punching cutters and the punching die are provided in a unit which is able to be drawn out of the casing.

A further embodiment of the invention provides an image forming apparatus;

wherein the punching means includes a plurality of punching cutters disposed at a predetermined interval in the width direction of the paper carried by the paper delivery means, and a punching die for receiving these punching cutters;

at least the punching cutters and the punching die can be drawn out of a casing which covers the punching means, and are disposed on a unit movable in the width direction of the paper; and the apparatus includes adjustment means for moving the unit in the width direction of the paper thereby to adjust the position of the punching means to punch holes in the paper.

A still further embodiment of the invention provides an image forming apparatus;

wherein the punching means includes a plurality of punching cutters disposed at a predetermined interval in the width direction of the paper carried by the paper delivery means, a punching die for receiving these punching cutters, and a collecting box which, being disposed under the punching die, receives paper scraps made by punching holes through an opening formed at the upper portion thereof, and stores the paper scraps therein;

at least the collecting box is disposed on a unit which is turnable and can be drawn out of a casing covering the punching means; and the unit is provided with means for always turning the opening of the collecting box upward when the unit is turned.

Another embodiment of the invention provides an image forming apparatus;

wherein a paper delivery means for carrying out of the apparatus paper whereon an image has been formed, and a punching means for punching holes in the paper being disposed on the paper delivery means.

In an image forming apparatus according to the invention, the discharge roller is controlled to temporarily stop so that the paper is halted with its trailing portion positioned in the punching means. When holes are punched, the paper temporarily halts with its trailing portion caught in the discharge roller and with its leading edge protruding out of the image forming apparatus. Accordingly, the paper does not come in contact with the constantly rotating delivery roller and the heat transferring device disposed in the upstream side of the punching means. The image forming apparatus according to the invention does not cause creasing of the paper or change in quality as holes are punched. Furthermore, since the punching means can be disposed in the vicinity of other parts of the paper delivery means, a large space is not required, and the apparatus can be miniaturized.

In another embodiment of the invention, a pushing means is fixed in a casing covering a punching means and punching cutters, and the punching die are disposed in a unit which is able to be drawn out of the casing. Drawing out of the unit casing disengages the punching cutters from the pushing means, setting the punching cutters free and exposing them outside of the casing. Accordingly, jam recovery is easily executed. As described above, since the jam recovery is performed outside of the casing, it does not require spare space for executing jam recovery within the casing, and the apparatus can be miniaturized.

In still another embodiment of the invention, a unit including the punching cutters and a punching die is able to be drawn out of a casing, is movable in the width direction of the copy paper and is provided with an adjustment means for moving the unit in the width direction of the paper. By moving the unit with this adjustment means, the position of the punching means to punch holes can be precisely adjusted in the width direction of the paper.

In a further embodiment of the invention, a unit comprising punching cutters, the punching die and the box for collecting paper scraps can be drawn out of a casing by turning the unit. The collecting box can be easily drawn out of the casing, because the collecting box is adapted to be exposed at the upper side of the unit. In addition, since the collecting box is tunably supported in such a manner as to always turn upward when the unit is turned, or an elastic member attached to the unit holds the opening of the collecting box always turned upward when the unit is turned, paper scraps contained in the box does not fall out.

In still further embodiment of the invention, timing to punch a hole is delayed for each punching cutter, and hence load on the driving system of the image forming apparatus is reduced, in comparison to a type wherein plural holes are punched at one time. The load thus reduced will not affect driving of the image forming apparatus. In addition, because it is not necessary to reinforce the transmission function of driving force, manufacturing costs can be reduced, and the image forming apparatus can be made smaller and less heavy.

DESCRIPTION OF THE PREFERRED EMBODIMENT

Figure 1:
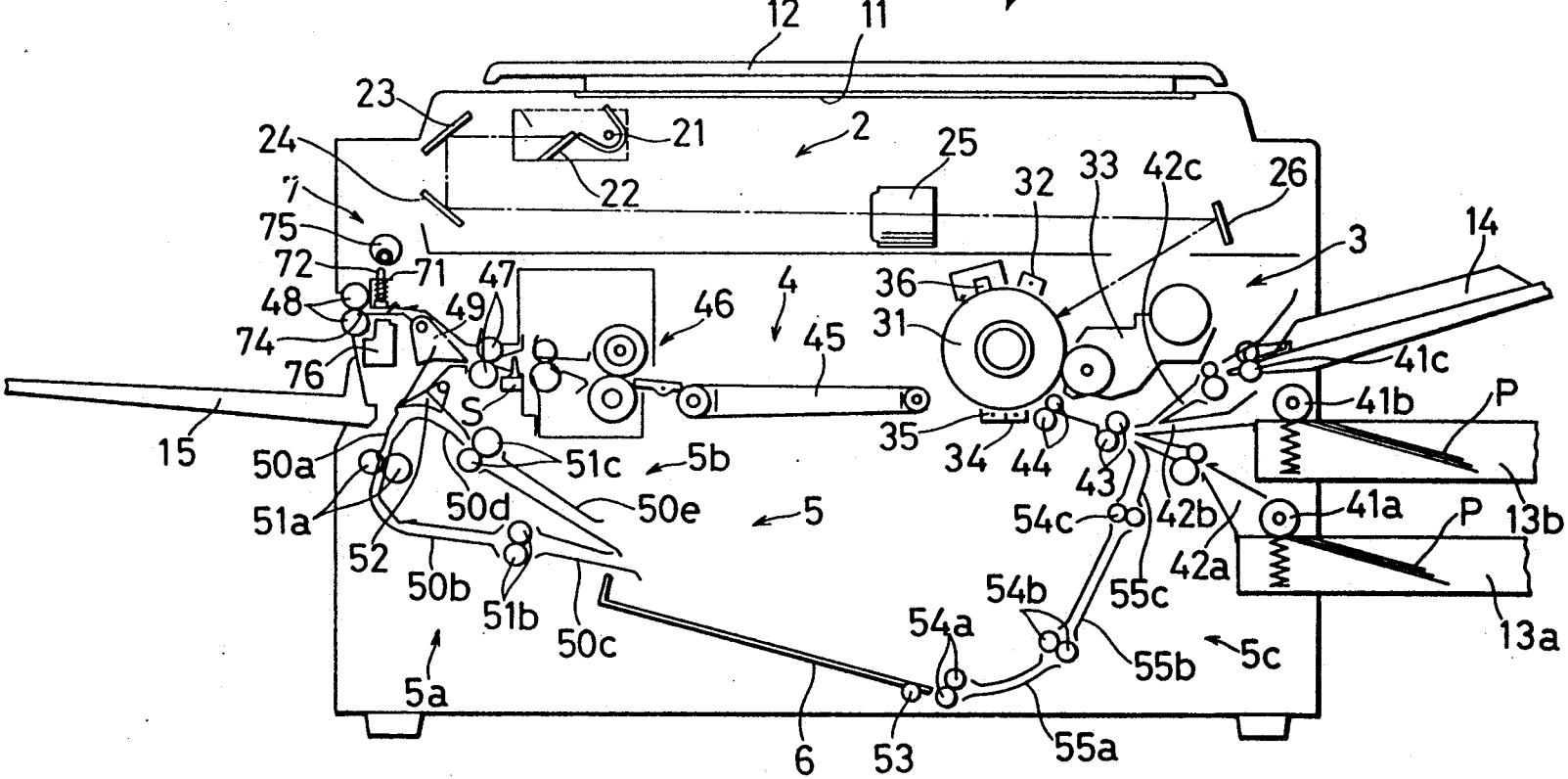
FIG. 1 is a schematic view illustrating the internal structure of an electrostatic copying apparatus as an embodiment of an image forming apparatus according to the present invention.

FIG. 1 shows the whole body of an electrostatic copying apparatus as an embodiment of an image forming apparatus according to the present invention. The electrostatic copying apparatus comprises a casing 1, wherein an optical system 2, an image forming means 3, a first paper delivery means 4, a second paper delivery means 5, an intermediate tray 6 and a punching means 7 are included.

On the upper part of the casing 1, there are provided a transparent plate 11 on which a document to be copied (not shown) is set, and a document holder 12.

The optical system 2 includes a light source 21, mirrors 22, 23, 24, lens 25 and a mirror 26. The optical system 2 exposes a document set on the transparent plate 11 with the light source 21, and conducts the reflected light from the document with mirrors 22, 23, 24, lens 25 and mirror 26 to the image forming means 3, as shown with the dot-and-dash line in FIG. 1.

The image forming portion 3 comprises a photosensitive drum 31 rotating in one direction, and a corona discharger 32, a developing device 33, a transferring corona discharger 34, a separating corona discharger 35 and cleaner 36 which are disposed around the photosensitive dram 31. The image forming process in the image forming portion 3 is executed in the following order. The surface of the photosensitive drum 31 is uniformly charged by the corona discharger 32, and on the charged surface of the photosensitive drum 31, the optical system 2 forms a document image to form an electrostatic latent image. Then, toner is electrostatically made to adhere to the electrostatic latent image by the developing device 33, thereby to form a toner image, and the toner image thus formed is transferred onto the surface of paper P by the transferring corona discharger 34. Then the paper P on which the toner image is transferred is separated from the surface of the photosensitive drum 31 by the separating corona discharger 35, and the cleaner 36 clears the toner remaining on the surface of the photosensitive drum 31 after separation of the paper P from the drum 31.

The first paper delivery means 4 comprises feed rollers 41*a*, 41*b*, 41*c*, feed passages 42*a*, 42*b*, 42*c*, registration rollers 43, delivery rollers 44, a delivery belt 45, a heat fusion device 46, delivery rollers 47 and a pair of discharge rollers 48 as a discharge means.

The feed rollers 41*a*, 41*b*, 41*c* feed the paper P sheet by sheet from paper feed cassettes 13*a*, 13*b* or from stacking bypass 14 which is detachably attached to a side portion of the casing 1.

The registration rollers 43 and the delivery rollers 44 deliver the paper P from the paper feed cassettes 13*a*, 13*b*, or the stacking bypass 14 to the image forming portion 3, timed to the rotation of the photosensitive drum 31.

The heat fusion device 46 applies heat and pressure on the surface of the paper P on which an image has been formed in the image forming portion 3, thereby to fuse the toner image on the surface of the paper P.

As the punching means 7 punches holes in the trailing portion of the paper P, the discharge rollers 48 are controlled to temporarily halt the paper P with its trailing portion set in the punching means 7. Therefore, when the holes are punched, the paper P temporarily halts with its trailing portion caught in the discharge rollers 48 and with its leading edge protruding from the casing 1. Accordingly, the paper P is not then in contact with the constantly rotating delivery rollers 47 or the heat transferring device 46, which are disposed in the upstream side of the punching means 7.

Figure 5:
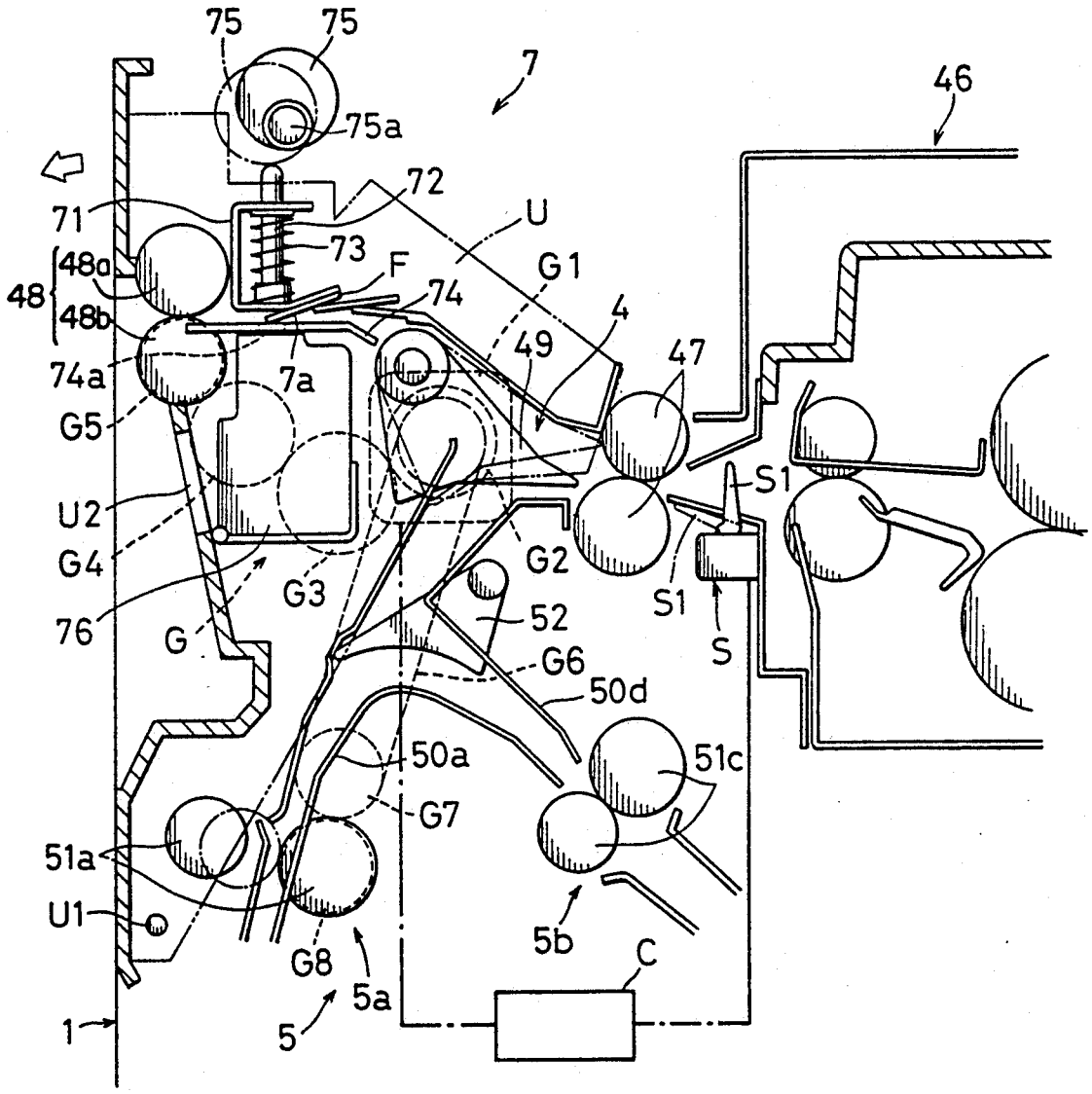
FIG. 5 is a sectional view illustrating the internal structure of the unit.

As shown with a broken line in FIG. 5, a drive control means for controlling the rotating of discharge rollers 48, as described above, includes a discharge drive system G, provided separately from the drive system of the copying apparatus, and a control system C for controlling the discharge drive system G according to a signal from a sensor S. The discharge drive system G includes a stepping motor G1 whose rotation is controlled according to a signal from the unit C, a gear G5 fitted to the lower roller 48*b* of the pair of discharge rollers 48 and a plurality of gears G2 to G4 for transmitting the rotation of the stepping motor G1 to the gear G5. The stepping motor G1 can rotate not only in the direction to carry paper out of the machine but also in the direction opposite to that. As described later, the motor is also used to rotate the delivery rollers 51*a* of the second paper delivery means in the forward and reverse directions.

In the drive control means, sensor S, disposed between the heat fusion device 46 and the delivery rollers 47 of the first paper delivery means 4, detects the trailing edge of the paper P discharged from the heat fusion device 46 after an image has been fused it. According to the detecting signal, the control system C stops the rotation of the stepping motor G1 to temporarily halt the drive of the discharge rollers 48, while the trailing portion of the paper P is in the punching means 7. When the punching means 7 has punched holes near the trailing edge of the paper P, the control system C starts the stepping motor G1 to drive the discharge rollers 48 again. Thus the paper P wherein holes have been punched is discharged onto a copy receiving tray 15 disposed outside of the copying apparatus.

Figure 6:
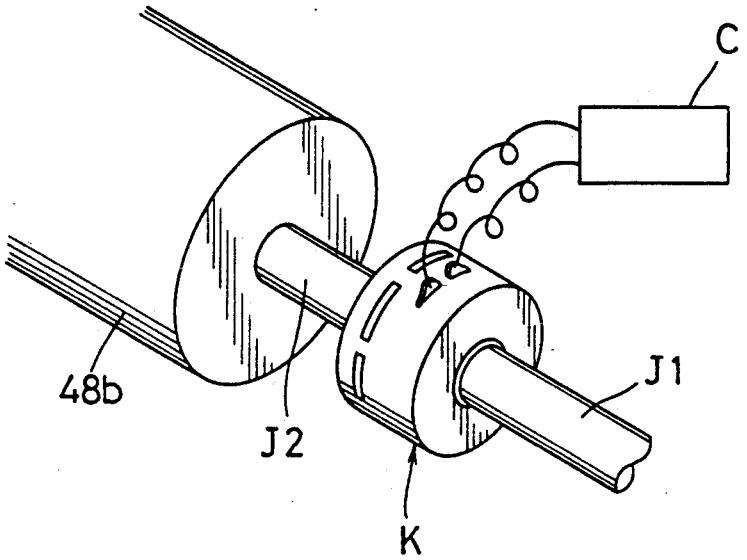
FIG. 6 is a perspective view showing a modification of a drive control means for controlling the drive of the discharge rollers.

As shown in FIG. 6, the drive control means may include an electromagnetic clutch K, disposed between any one J1 of the drive shafts of the drive system of the copying apparatus and one 48*b* of the pair of discharge rollers 48, and the control system C for switching the clutch K according to the signal from the sensor S.

The timing to temporarily stop the discharge rollers 48 when the sensor S has detected the trailing edge of the paper P can be set according to the following means:

a timer which starts measuring time when the sensor S detects the trailing edge of the paper P, and which outputs a signal when it determines the expiration of a predetermined period of time.

A pulse counter which converts the rotation of the discharge rollers 48 and such, into pulses by means of a rotary encoder and the like, and which outputs a signal when it has counted a predetermined number of pulses.

A timer or pulse counter having an adjustment function for adjusting a predetermined time or a predetermined number of pulses before outputting a signal also can be used as the means. The timer or pulse counter having the adjustment function may serve as an adjustment means for adjusting timing for the drive control means to temporarily stop the discharge rollers 48, so that the position of punched holes may be varied in the longitudinal direction of the paper. If the timer adjusts a predetermined period of time by an amount in the range from 0 to a given number of seconds or if the pulse counter adjusts a predetermined pulse count by an amount in the range from 0 to a given value, for example, the timing to stop the discharge rollers 48 after the sensor S has detected the trailing edge of the paper P can be adjusted. The timing adjustment may be executed through an operation means such as selection switches provided on the operation board on the main body of the copying apparatus 1.

The paper P delivered from the heat fusion device 46 pushes down the arm S1 of the sensor S as a detecting means, as illustrated with dot-and-dash line in FIG. 5, and when the paper P passes through the arm S1, this arm S1 stands up again as illustrated with a solid line in the FIG. 5, to let the sensor S detect the trailing edge of the paper P.

Then the sensor S is connected to a jam detection portion (not shown) for detecting a paper jam. The jam detection portion checks whether the arm S1 stands up or not when a predetermined time has passed after the paper P delivered from the heat fusion device 46 pushed down the arm S1. If the arm S1 does not stand up, considering it to be a jam, the detection portion stops the electrostatic copying apparatus and gives an indication of a jam.

The drive control means may comprise;

a drive source for driving the discharge rollers 48, which is provided independently of the drive system of the copying apparatus, and a control system for controlling the independent drive source according to a signal from the control system.

As shown in FIG. 1, the second paper delivery means 5 is diverged from a switching claw 49, disposed between the delivery rollers 47 and the discharge rollers 48, and is connected to registration rollers 43 through an intermediate tray 6.

The second paper delivery means 5 comprises;

the first half portion 5*a* which diverges from the switching claw 49 and leads the paper P in the intermediate tray 6;

a reversing portion 5*b* which diverges from the switching claw 52 disposed in the first half portion 5*a* and which leads the reversed paper P onto the intermediate tray 6;

the latter half portion 5*c* covering from a feed repeat rollers 53 to the registration rollers 43. The first half portion 5*a* includes guide passages 50*a*, 50*b*, 50*c*, delivery rollers 51*a*, 51*b*, and switching claw 52. The reversing portion 5*b* includes guide passages 50*d*, 50*e*, and delivery rollers 51*c*. The latter half portion 5*c* includes feed repeat rollers 53, delivery rollers 54*a*, 54*b*, 54*c*, and feed passages 55*a*, 55*b*, 55*c*.

The delivery rollers 51*a* of the second paper delivery means are, as described above, driven by the stepping motor G1 of the discharge drive system G. That is, the rotation of the stepping motor G1 is transmitted to the delivery rollers 51*a* through a timing belt G6, and gears G7, G8, as shown in broken lines in FIG. 5.

To execute an image forming process once on the paper P by using an electrostatic copying apparatus of this embodiment, the paper P whereon an image has been formed in the image forming portion 3 is carried by the first delivery portion 4 to be discharged on the copy receiving tray 15.

To execute an image forming process on the same paper P for two or more times by using the electrostatic copying apparatus, the switching claw 49 is switched as illustrated with dot-and-dash line in FIG. 5, and the paper P, whereon the image forming portion 3 has formed an image, is delivered to the second paper delivery means 5. After staying in the intermediate tray 6 for a time, the paper P is delivered to the image forming portion 3 to form another image thereon. To execute the image forming process on the same side of the paper P for the second time, the paper P with the image formed thereon is carried through the first half portion 5*a* of the second paper delivery means 5, in which the paper is turned over; to the intermediate tray 6, and then the paper P moves through the latter half portion 5*c*, in which the paper is turned over a second time, to enter the image forming portion 3 again. During this, the delivery rollers 51*a* rotate in the same direction with the other delivery rollers 51*b*. In the image forming process to execute the second image forming apparatus on the backside of the same paper P, the paper whereon the first image is formed is delivered into the first half portion 5*a* of the second paper delivery means 5, where the delivery rollers 51*a*, 51*b* of the first half portion 5*a* are rotated in the opposite direction to carry the paper P from the switching claw 52 to the reversing portion 5*b*. The paper P is not turned over when it is delivered through the reversing portion 5*b* to the intermediate tray 6, and the paper P is carried through the latter half portion 5*c*, in which the paper is turned over, to the image forming portion 3.

The punching means 7 is disposed between the switching claw 49 and the discharge rollers 48 in the first paper delivery means 4. As shown in FIGS. 5 to 10, the punching means 7 comprises a supporter 71, a pair of punching cutters 72 vertically movable and supported by the supporter 71, coil springs 73 for retaining these punching cutters 72 upward, a punching die 74 for receiving the punching cutters 72, and cams 75 as means for pressing punching cutters 72 downward, thereby to punch holes in the paper P.

Figure 2:
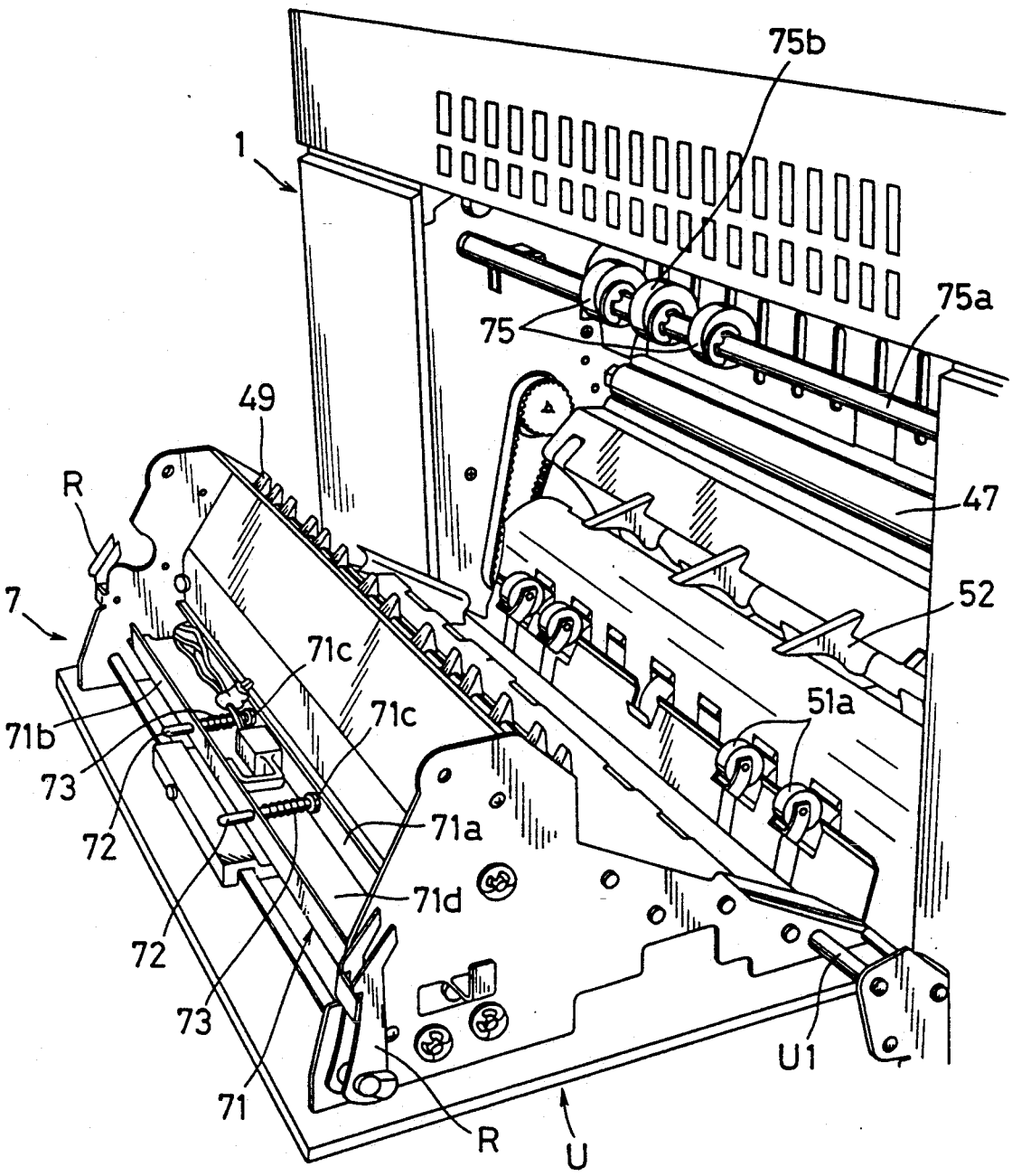
FIG. 2 is a perspective view showing a state when a punching unit is turned and drawn out of the casing of the copying apparatus in the embodiment.

Of the components, the supporter 71, punching cutters 72, coil springs 73, and punching die 74 are disposed in the upper part of the unit U illustrated with a two-dot-and-dash line in FIG. 5, with the switching claw 49, the discharge rollers 48, and the collecting box 76 disposed under the punching die 74 in the first paper delivery means 4. The unit U can be drawn out in one piece from the casing 1 by pivoting the unit around shaft U1. As shown in FIG. 2, the pair of cams 75 of the punching means 7 are attached to one rotary shaft 75*a* disposed in the casing 1, thus being provided in the casing 1.

As shown in FIGS. 2, 5, and 7–10, the supporter 71 is composed of a channel bar comprising a pair of horizontal side plates 71*a*, 71*b* and a vertical side plate 71*d*. Of the supporter 71, the bottom surface of the lower horizontal side plate 71*a* also serves as the upper side plate of the guide passage 7*a* for guiding the paper P. Through holes for inserting the punching cutters 72 are formed in the horizontal side plates 71*a*, 71*b*. Bushes 71*c* with punching cutters 72 inserted are mounted on the surface of the lower horizontal side plate 71*a*, and the coil springs 73 are fit around these bushes 71*c*. On the back side of the lower side plate 71*a*, there are attached paper holders F, which guide the paper P toward the punching die 74 and prevent corners of the paper P from being caught in the through holes in the horizontal side plate 71*a*.

Figure 11:
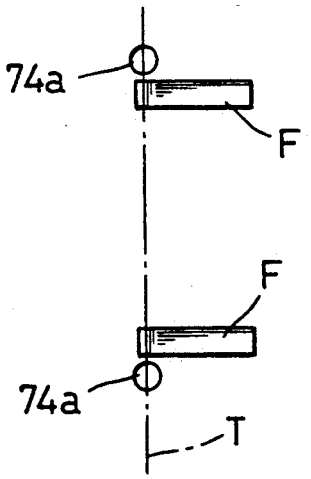
FIG. 11 is a plan view showing a punching die and paper holders in the punching means.

The paper holders F are composed of a elastic thin sheet, such as a synthetic resin film consisting of polyethylene terephthalate, or a metal sheet consisting of copper phosphate. As shown in FIG. 11, the paper holders F are disposed near the through holes 74*a* in the punching die 74. As shown in the FIG. 11, it is preferable that the edges of the paper holders F at least reach the line T shown in FIG. 11 as a dot-and-dash-line running through the centers of the through holes 74*a*, and more preferably that the edges of the paper holders F extend over the line T to the downstream side (toward the left in FIG. 11). If the edges of the paper holders F fail to reach the line T, it is possible that the paper holders F cannot adequately retain the paper P when the paper P is caught on the punching cutters 72 and so move upward along with the cutter.

The punching cutter 72 has a cutting edge 72*b* on its lower end. The upper part of the punching cutter 72 is a column form portion contacting the cam 75, and a flange 72*a* is formed in the midway portion thereof. The punching cutter 72 is inserted through the through holes in the upper and lower horizontal side plates 71*a*, 71*b* of the supporter 71, being vertically movable and having its flange 72*a* disposed between these horizontal side plates 71*a*, 71*b*. Between flange 72*a* and the lower horizontal side plate 71*a*, there is interposed a coil spring 73, which urges the punching cutter 72 upward.

The punching die 74 comprises a plate in which the through holes 74*a*, 74*b* for the punching cutters 72 to enter are formed at positions corresponding to the punching cutters 72, (FIGS. 5 and 7 to 9 show only one of the punching cutters arranged vertically to the surface of the paper.) The punching die 74 also serves as the lower side plate of the guide passage 7*a* for guiding the paper P.

Figure 7:
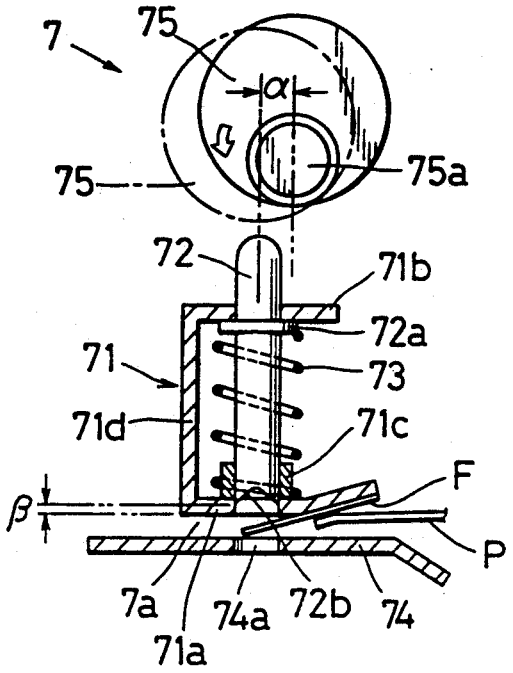
FIGS. 7 to 9 are sectional views illustrating the operation of the punching means in the embodiment.
Figure 8:
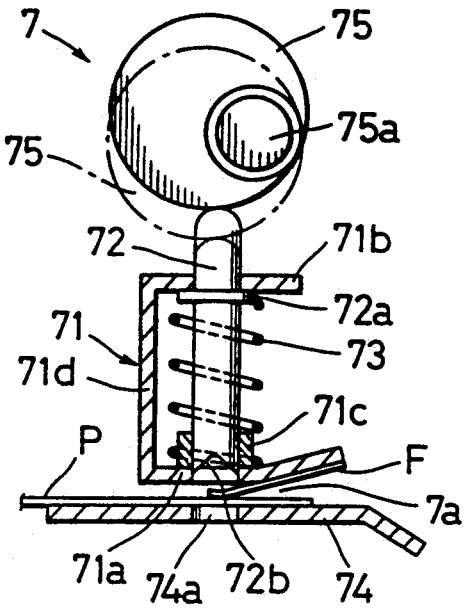
Figure 9:
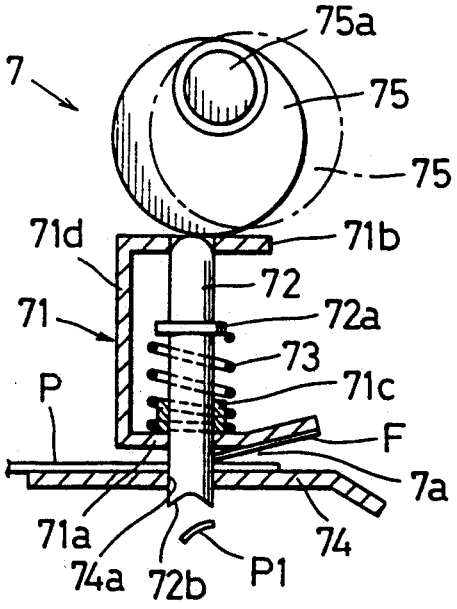

As described above, a pair of cams 75 are attached to one rotary shaft 75*a* disposed in the casing 1, thus the cam 75 is provided in the casing 1. The drive system of the copying apparatus rotates the rotary shaft 75*a* to run the cams 75, as shown in FIGS. 7 to 9, and thus the cams pressure the punching cutters 72 downward so as to punch holes in the paper P.

In the punching means 7, with rotating of the cams 75 to apply pressure of a cam 75 efficiently downward on the associated punching cutter 72 as the cam 75 rotates the punching cutter 72 is depressed. To aid this, the axis of the rotary shaft 75*a* is horizontally shifted by a length "$\alpha$" with respect to the longitudinal axis of the punching cutter 72, as shown in FIG. 7.

Figure 10:
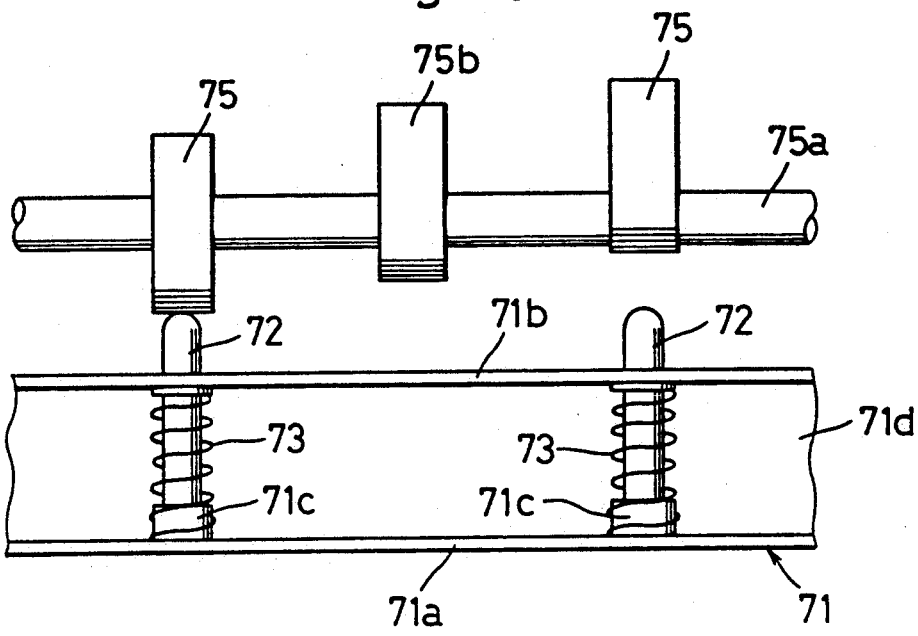
FIG. 10 is a side view of the punching means.

As shown with dot-and-dash line in FIGS. 5 and 7 to 9 and with solid line in FIG. 10, the pair of cams 75 are attached to the rotary shaft 75*a* with their phases shifted with respect to each other, so that timing for the punching cutters 72 to punch holes is staggered, and thus the load on the rotary shaft 75*a* or the driving system is reduced.

As shown in FIGS. 2 and 10, a third cam 75*b* is disposed between the pair of cams 75, so as to provide for three punch holes standardized in the United States. To punch the paper P with a third hole by using the third cam 75*b*, three punching cutters may be provided on the supporter 71. To punch four or more holes in the paper P, a rotary shaft having the same number of cams as the number of holes may be attached to the casing 1, and a supporter having the same number of punching cutters may be attached to the unit U.

The collecting box 76 is for collecting paper scraps P1 made after the punching cutters 72 punch holes (shown in FIG. 9), and box 76 is disposed beneath the through holes of the punching die 74.

Figure 3:
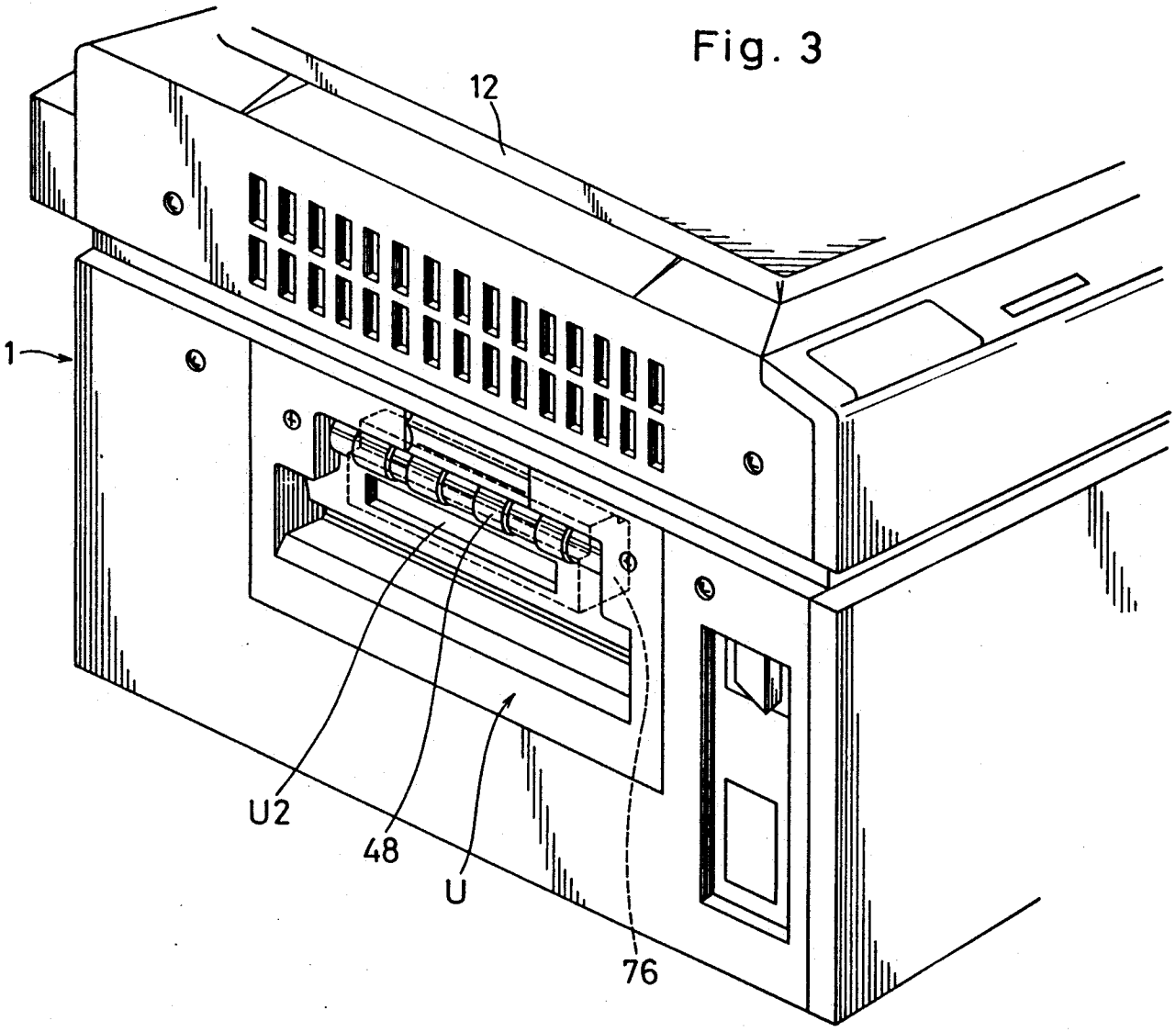
FIG. 3 is a perspective view showing a state when the punching unit is within the casing.

As shown in FIGS. 3 and 5, a window U2 is provided in the front side of the unit U. A transparent plate made of synthetic resin or the like fitted in the window U2, thereby to permit checking of the amount of paper scraps contained in the collecting box 76.

Figure 4:
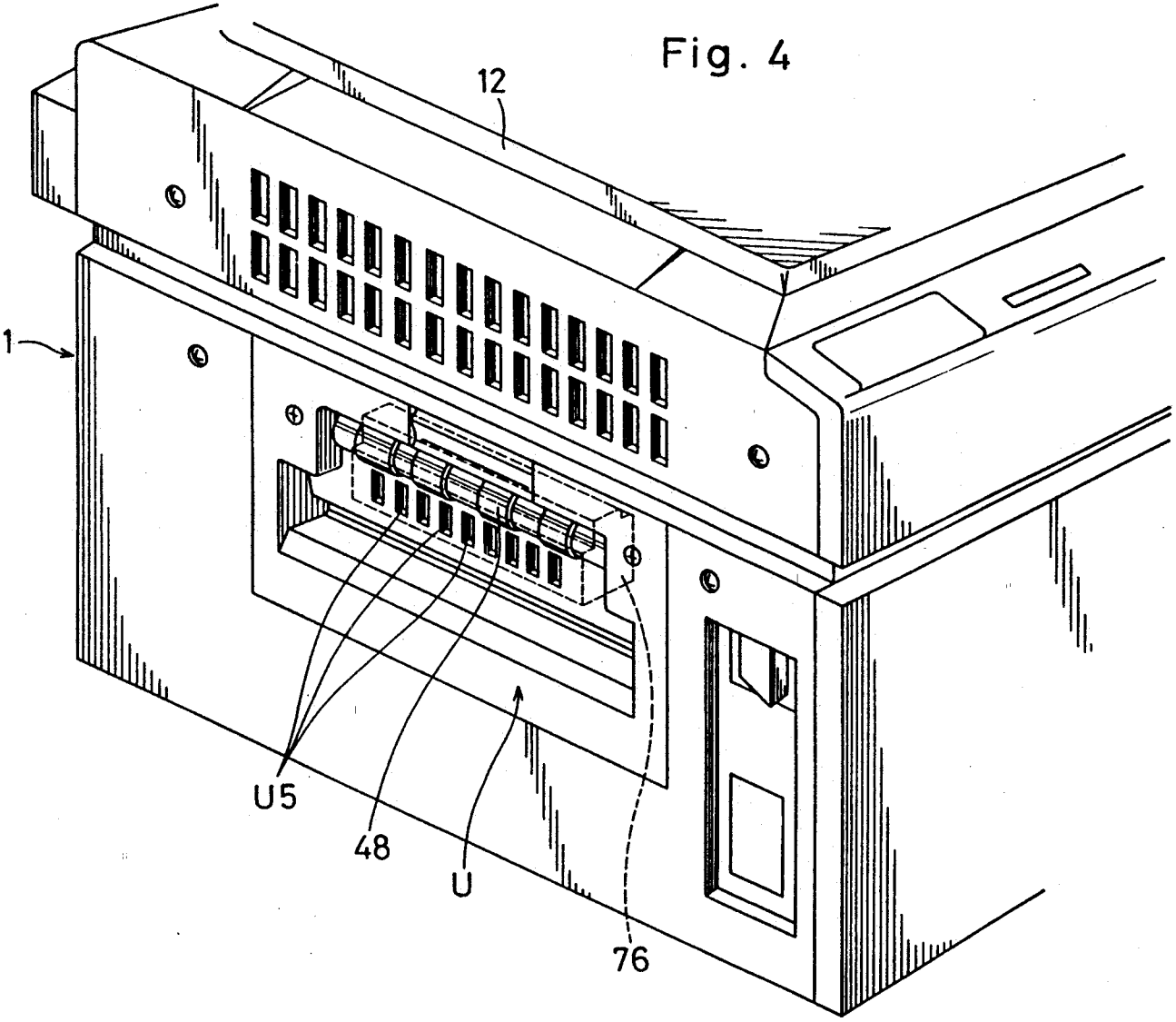
FIG. 4 is a perspective view showing a modification of a window.

Alternatively, instead of using the window U2 having a transparent plate, the window U2 may be composed of a plurality of slits, of a size which will not allow fingers to enter within the machine for safety reasons (around 5 mm width 30 mm length), as shown in FIG. 4.

The window U2 may be disposed in the front side of the casing 1. In this case, there may be provided notches about the same size of the window in each of the components intervening between the front side of the casing 1 and the collecting box 76.

When paper crumbs or the like which are produced by punching are caught in the punching means, the punching cutter 72 is locked and a paper jam is caused. In that event lock claws R disposed on the sides of their casing 1 are disengaged from the engaged portions (not shown), as shown in FIG. 2. Then, as shown in the FIG. 2, the unit U is pivoted and drawn out of the casing 1, and the connection between the cams 75 provided in the casing 1 and the punching cutters 72 disposed in the unit U is released. This sets the punching cutters 72 free and exposes them outside of the casing 1. With the punching cutters 72 pulled up, jam recovery can be easily executed.

When the punching means 7 is punching holes and a jam occurs in other parts, and the electrophotostatic copying apparatus is with the punching cutters 72 held down by the cams 75 the unit U is pivoted and drawn out of the casing 1, thereby to release the coupling of the cams 75 provided in the casing 1 and the punching cutters 72 disposed in the unit U. This sets the punching cutters 72 free, and jam recovery can be easily executed.

For removing paper scraps P1 in the collecting box 76, the collecting box 76 can be taken out with pivoting and drawing out the unit U from the casing 1.

Figure 12:
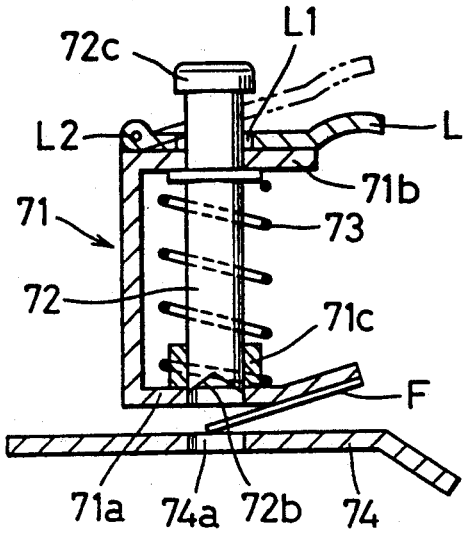
FIGS. 12 and 13 are sectional views illustrating modifications of the punching means.
Figure 13:
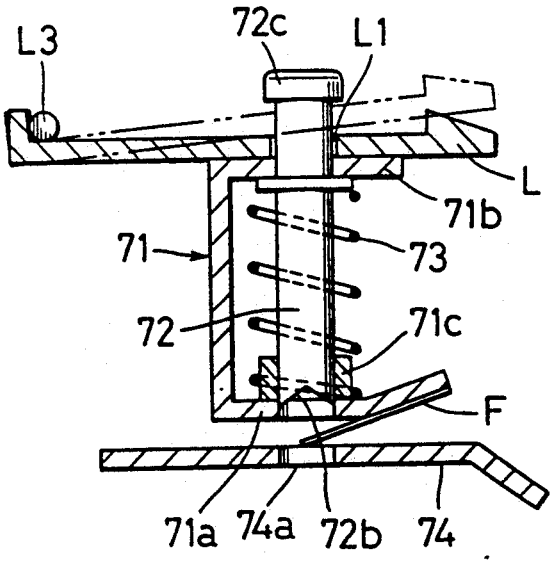

As shown in FIGS. 12 and 13, the punching means 7 may be provided with a lever L for lifting up the punching cutter 72.

The lever L in FIG. 12 has a through hole L1, for the punching cutter 72 to enter at the center thereof, and is mounted on the upper horizontal side plate 71*b* of the supporter 71 in such a manner as to be pivotable on a shaft L2. At the upper end of the punching cutter 72, there is formed a flange 72*c* to come in contact with the circumference of the through hole L1 of the lever L. Pivoting the lever L will bring the flange portion 72*c* into contact with the circumference of the through hole L1, and thus the punching cutter 72 is lifted up.

The lever L in FIG. 13 is the same with the lever L in FIG. 12, except that a shaft L3 is provided on the unit U.

Figure 14:
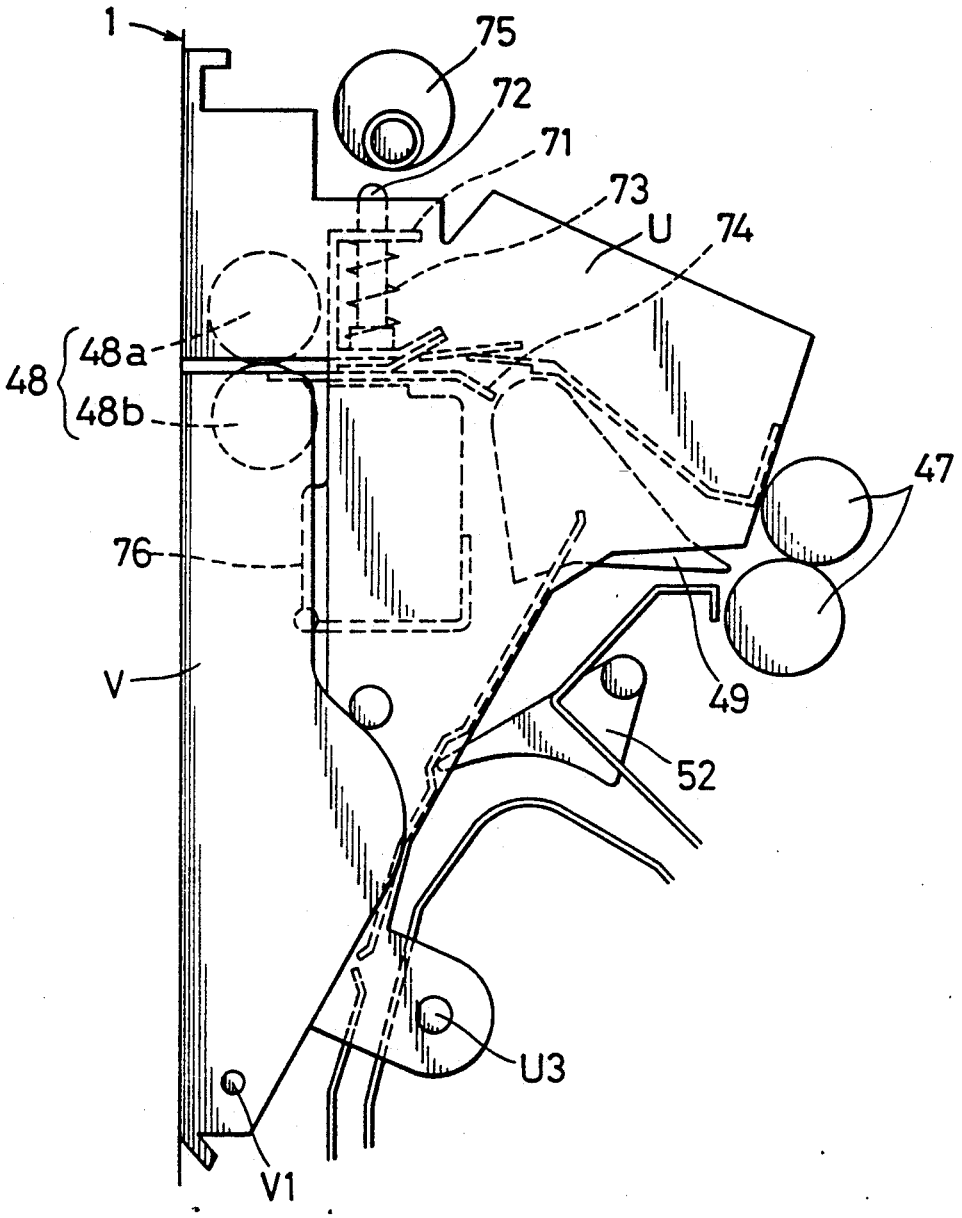
FIGS. 14 to 16 are sectional views illustrating modifications of the unit.
Figure 15:
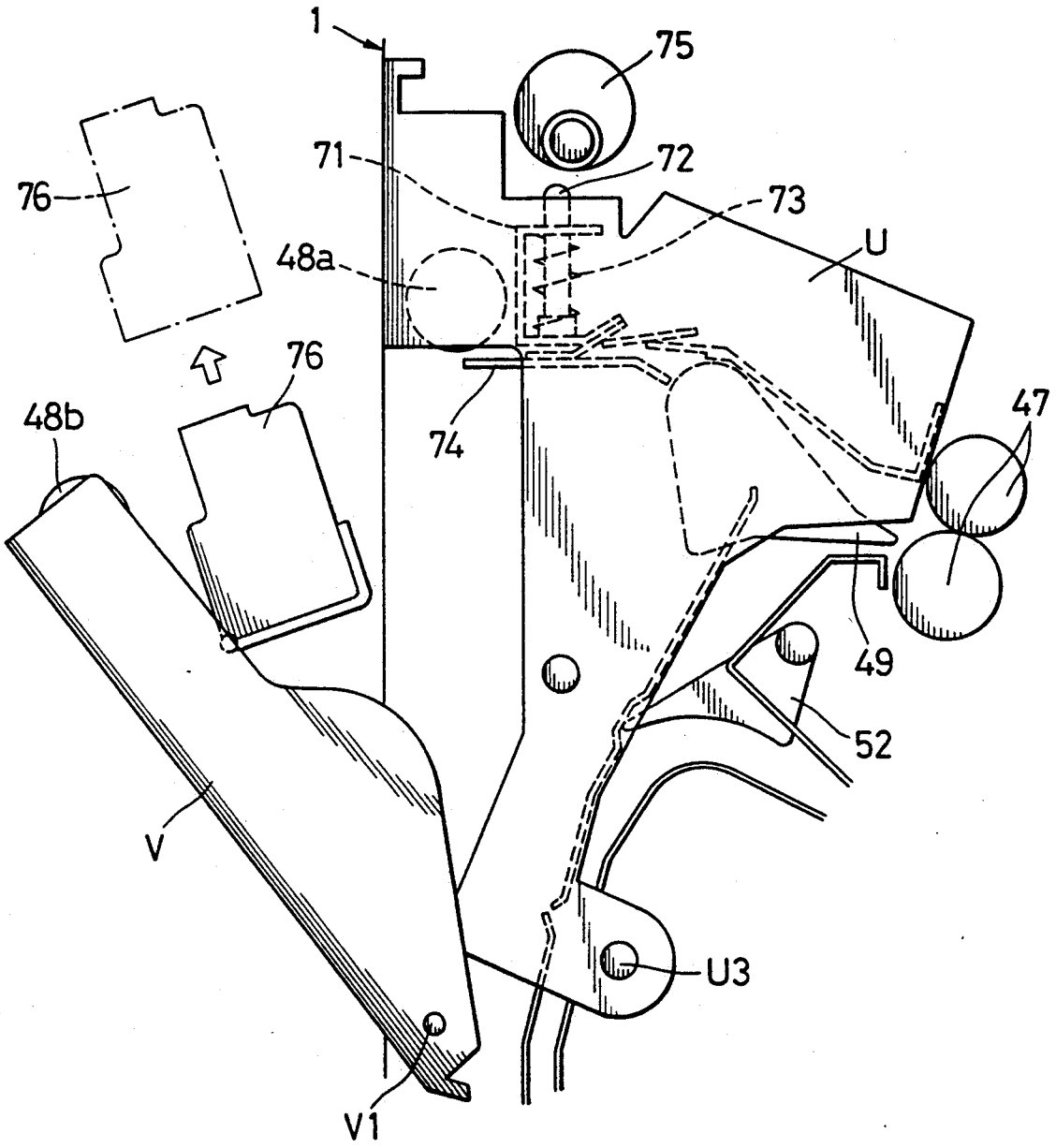
Figure 16:
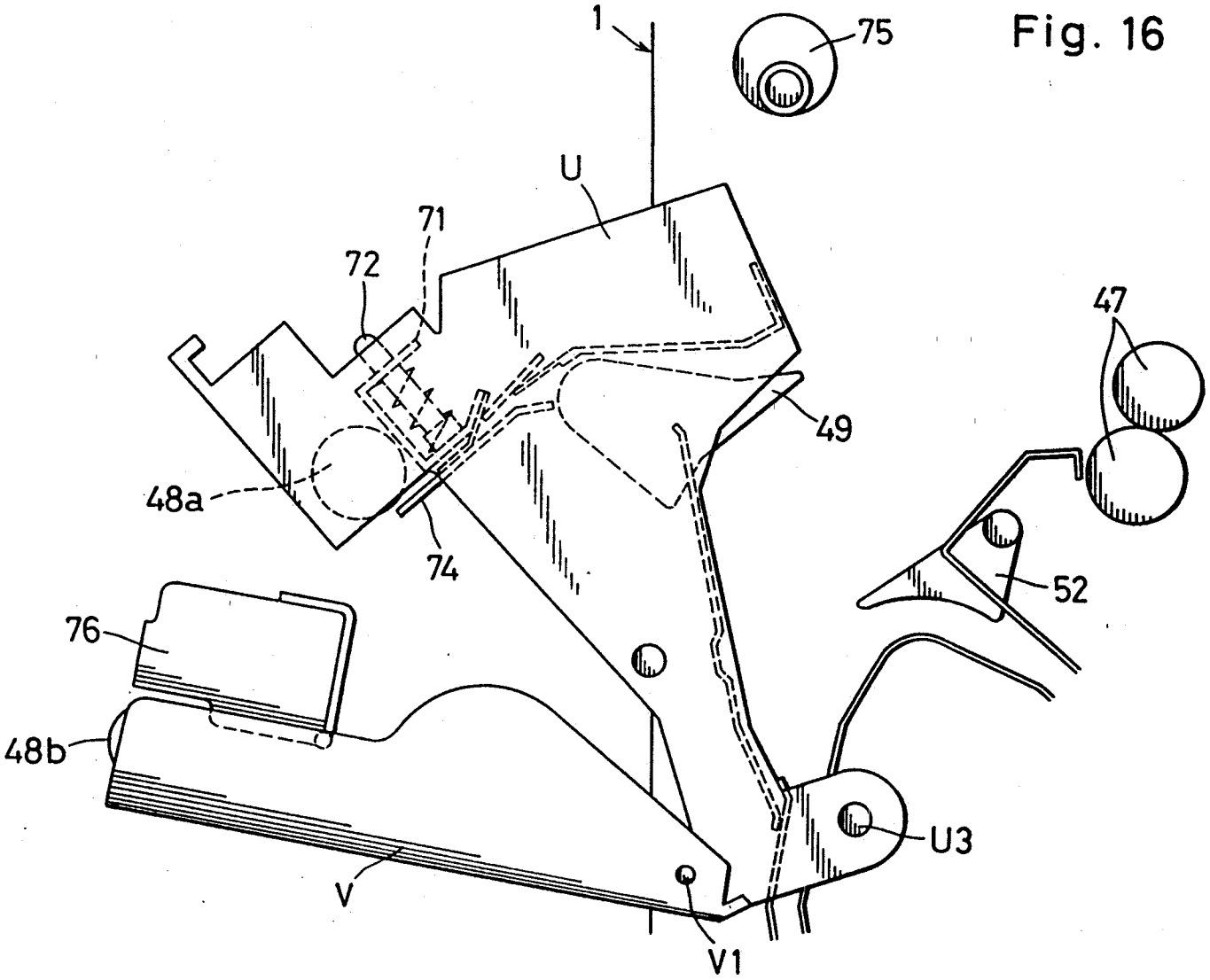

As shown in FIGS. 14 to 16, there may be also provided a main unit U and a sub unit V, as units which can be drawn out of the casing 1. These units can be separately drawn out of the casing 1.

The main unit U is provided with the supporter 71, punching cutters 72, coil springs 73, punching die 74, switching claw 49 and the upper rollers 48*a* of the pair of discharge rollers 48. The unit U can be pivoted on a shaft U3 and be drawn out in one piece from the casing 1.

The sub unit V is provided with the collecting box 76 and the lower roller 48*b* of the discharge rollers 48. The sub unit V can be pivoted out in one piece from the casing 1.

In treating a jam which does not involve the punching means 7, for example, in case the jam occurred in parts other than the punching means 7 and stops the copying apparatus with the punching cutters 72 not pressed down by the cam 75 while the paper P is caught between the rollers 48*a*, 48*b*, the sub unit V is pivoted and drawn out of the casing 1, as shown in FIG. 15. This releases the contact of the rollers 48*a*, 48*b*, and thus the paper P caught between the rollers 48*a*, 48*b* can be removed.

In removing the paper scraps P1 in the collecting box 76, the sub unit V is turned and drawn out of the casing 1, and thus the collecting box 76 can be drawn out of the sub unit V, as shown with dot-and-dash line in FIG. 15.

In the case of a paper jam involving the punching means 7, such as a lock-in of the punching cutter 72 due to paper crumbs caught in the unit 7, or stoppage of the copying apparatus with the punching cutters 72 pressed down by the cams 75 due to a paper jam that occurred in other parts, the sub unit V as well as the main unit U are pivoted and drawn out of the casing 1, as shown in FIG. 16. This disconnects the cams 75 and the punching cutters 72, setting the punching cutters 72 free and exposing the cutters outside of the casing 1. With the punching cutters 72 pulled up, jam recovery can be easily executed.

Figure 17:
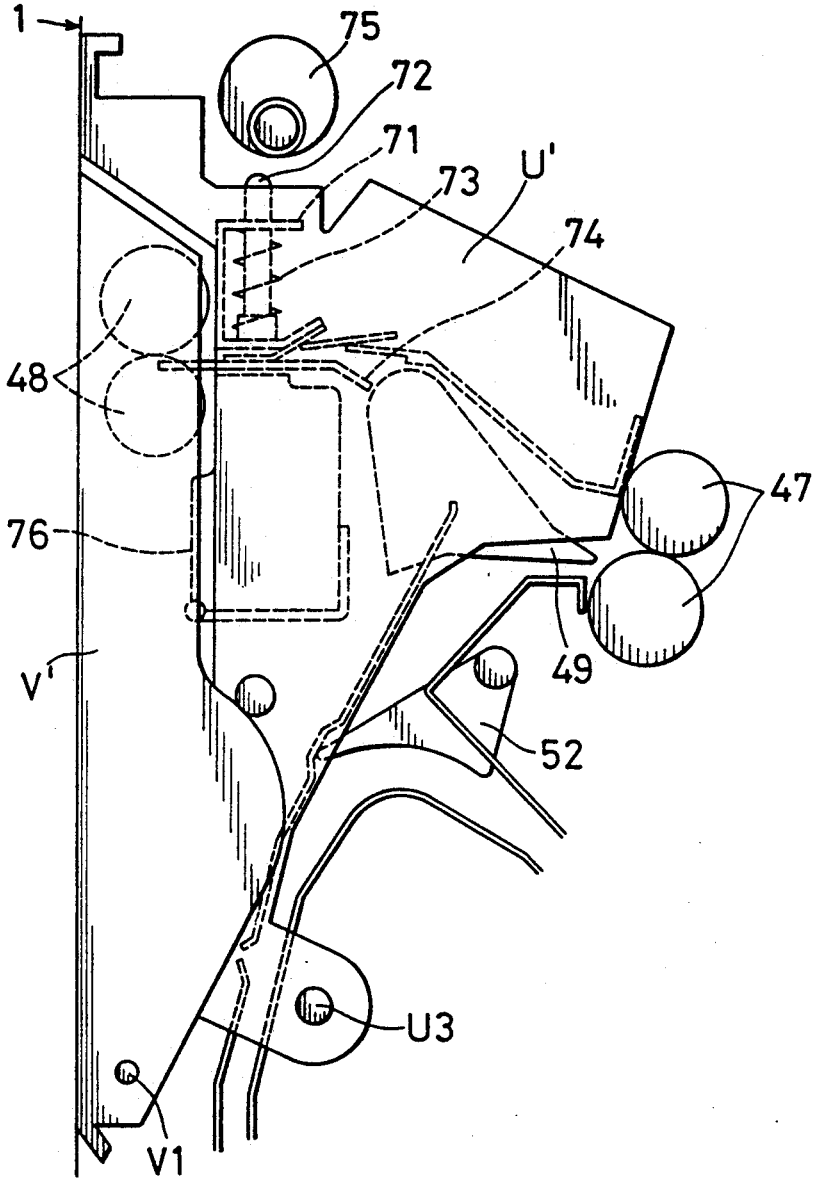
FIGS. 17 and 18 are sectional views showing other modifications of the unit.
Figure 18:
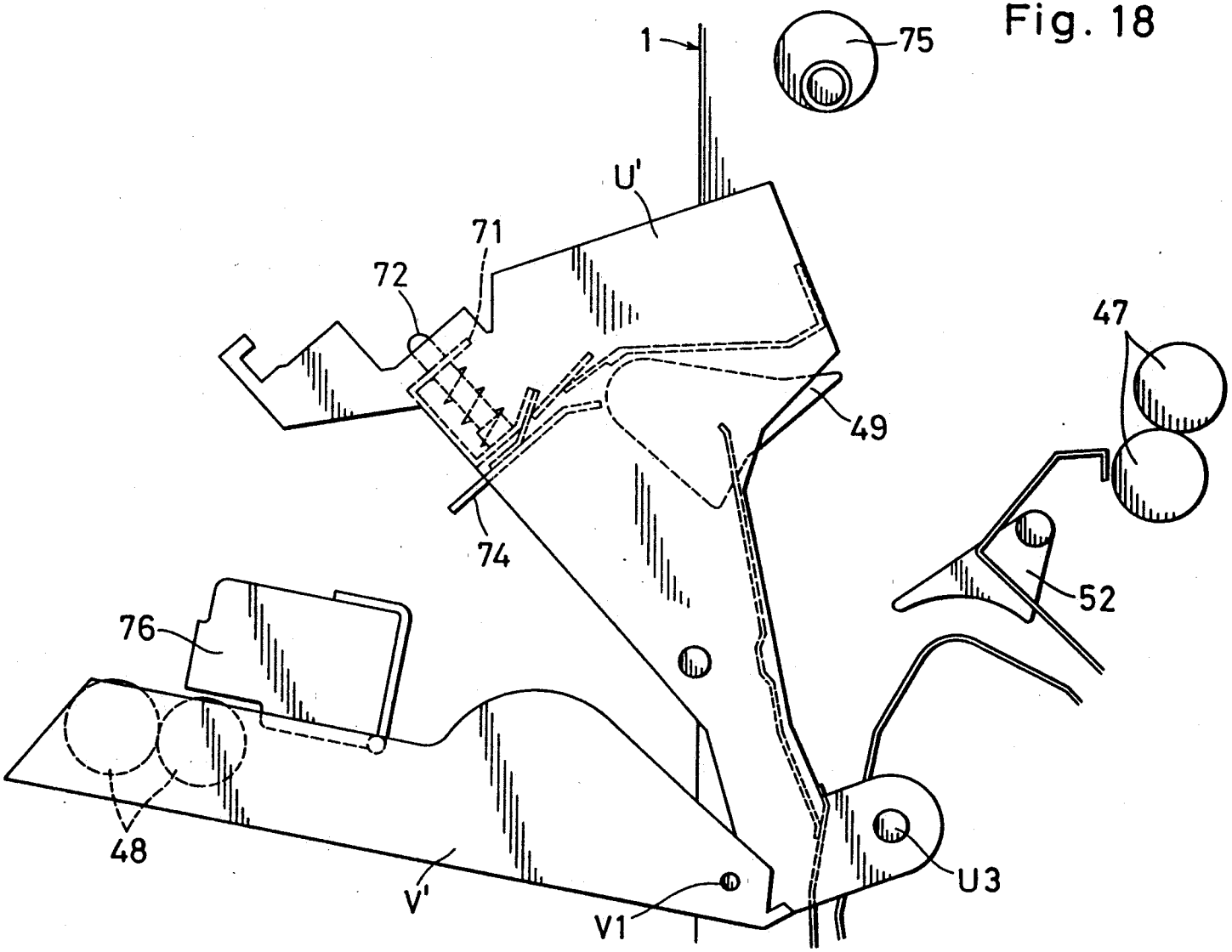

In FIGS. 17 and 18, there are provided a main unit U' and a sub unit V', which can be separately drawn out of the casing 1 in the same manner as the above.

The main unit U' is provided with supporter 71, punching cutters 72, coil springs 73, punching die 74, and switching claw 49. The unit U can be pivoted around shaft U3 and be drawn out in one piece from the casing 1. The sub unit V' is provided with the pair of discharge rollers 48 and collecting box 76. The sub unit V' can be pivoted on shaft V1 and be drawn out in one piece from the casing 1.

In treating a jam which does not involve the punching means 7, for example, in case a jam which occurred in parts other than the punching means 7 and stops the apparatus with the punching cutters 72 not pressed down by the cams 75 while the paper P is caught between the pair of discharge rollers 48, the sub unit V' is pivoted on shaft V1 and drawn out in one piece from the casing 1. Then the paper P caught between the discharge rollers 48 can be removed.

In removing the paper scraps P1 in the collecting box 76, the sub unit V' is pivoted and drawn out of the casing 1, and then the collecting box 76 can be detached from the sub unit V.

In the case of a paper jam involving the punching means 7, such as lock-in of the punching cutters 72 due to paper crumbs caught in the unit 7, or stoppage of the machine with the punching cutters 72 pressed down by the cams 75 due to a paper jam that occurred in other parts, the sub unit V' as well as the main unit U' are pivoted and drawn out of the casing 1. This disconnects the cams 75 and the punching cutters 72, setting the punching cutters 72 free and exposing the cutters 72 outside of the casing 1. With the punching cutters 72 pulled up, jam recovery can be easily executed.

Figure 19:
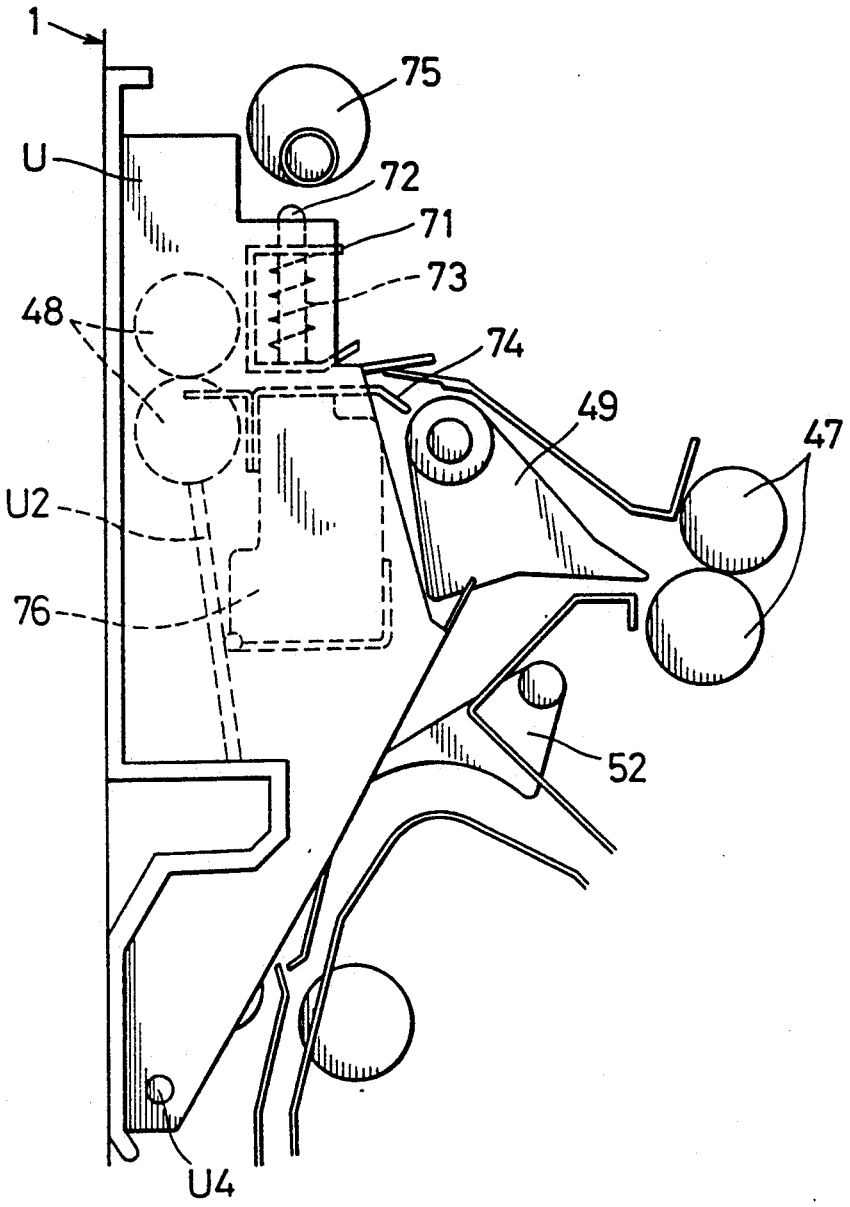
FIGS. 19 and 20 are sectional views illustrating other modifications of the unit.
Figure 20:
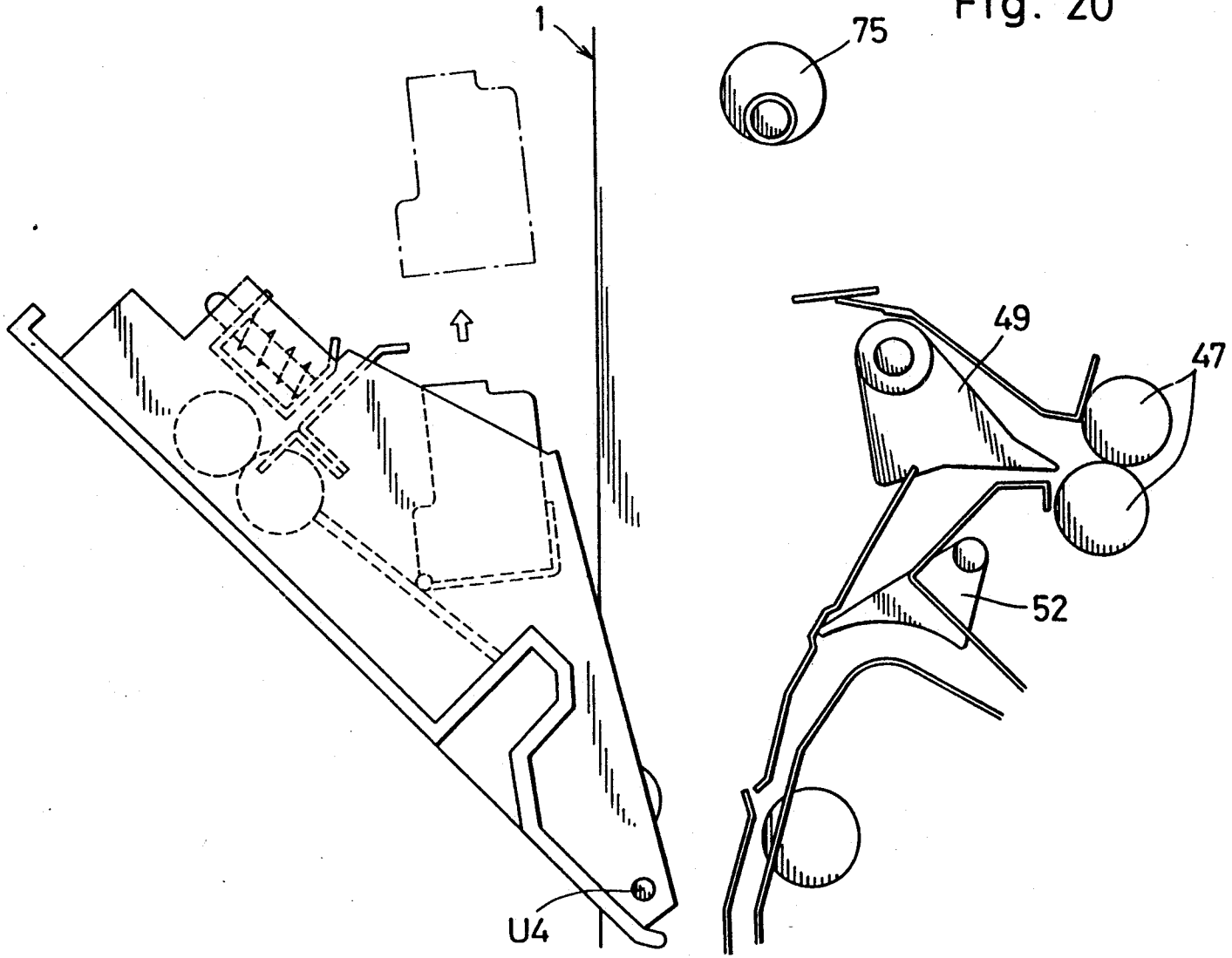

The unit U' in FIGS. 19 and 20 is provided with supporter 71, punching cutters 72, coil springs 73, punching die 74, collecting box 76 and discharge rollers 48. The unit U" can be pivoted on a shaft U4 and be drawn out in one piece from the casing 1. As shown the dot-and-dash line in FIG. 20, the collecting box 76 can be detached from the unit U" for removing paper scraps P1 therein.

Thus unit U" has an advantage that since the switching claw 49 is provided in the casing 1, the unit U" is smaller than that in FIG. 1 by the space required for the switching claw 49. In addition, because of being smaller, the unit U" is easier to pivot.

Figure 21:
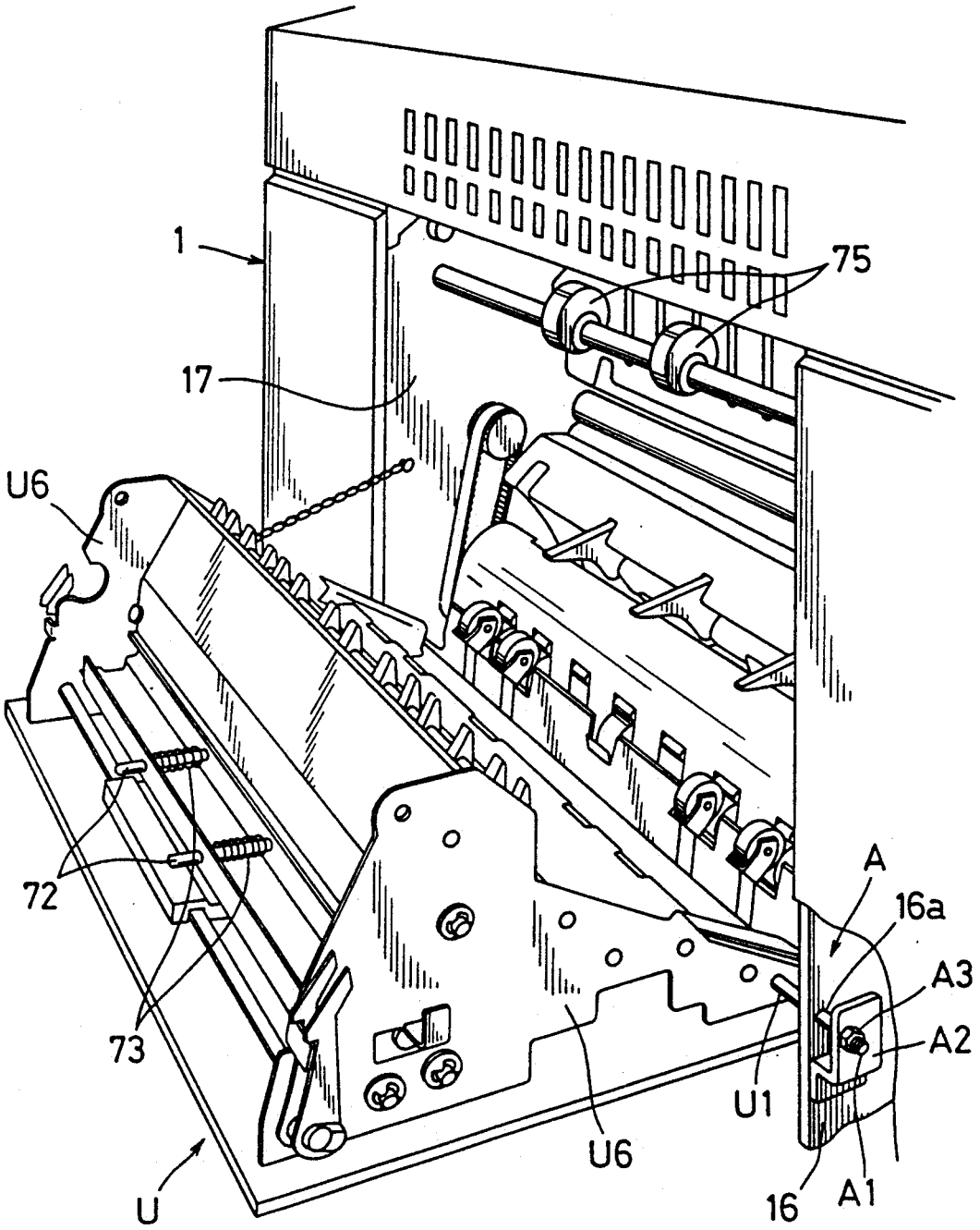
FIG. 21 is a perspective view showing a state when a unit is turned and drawn out of the casing in an embodiment provided with a unit movable in the width direction of the paper.
Figure 22:
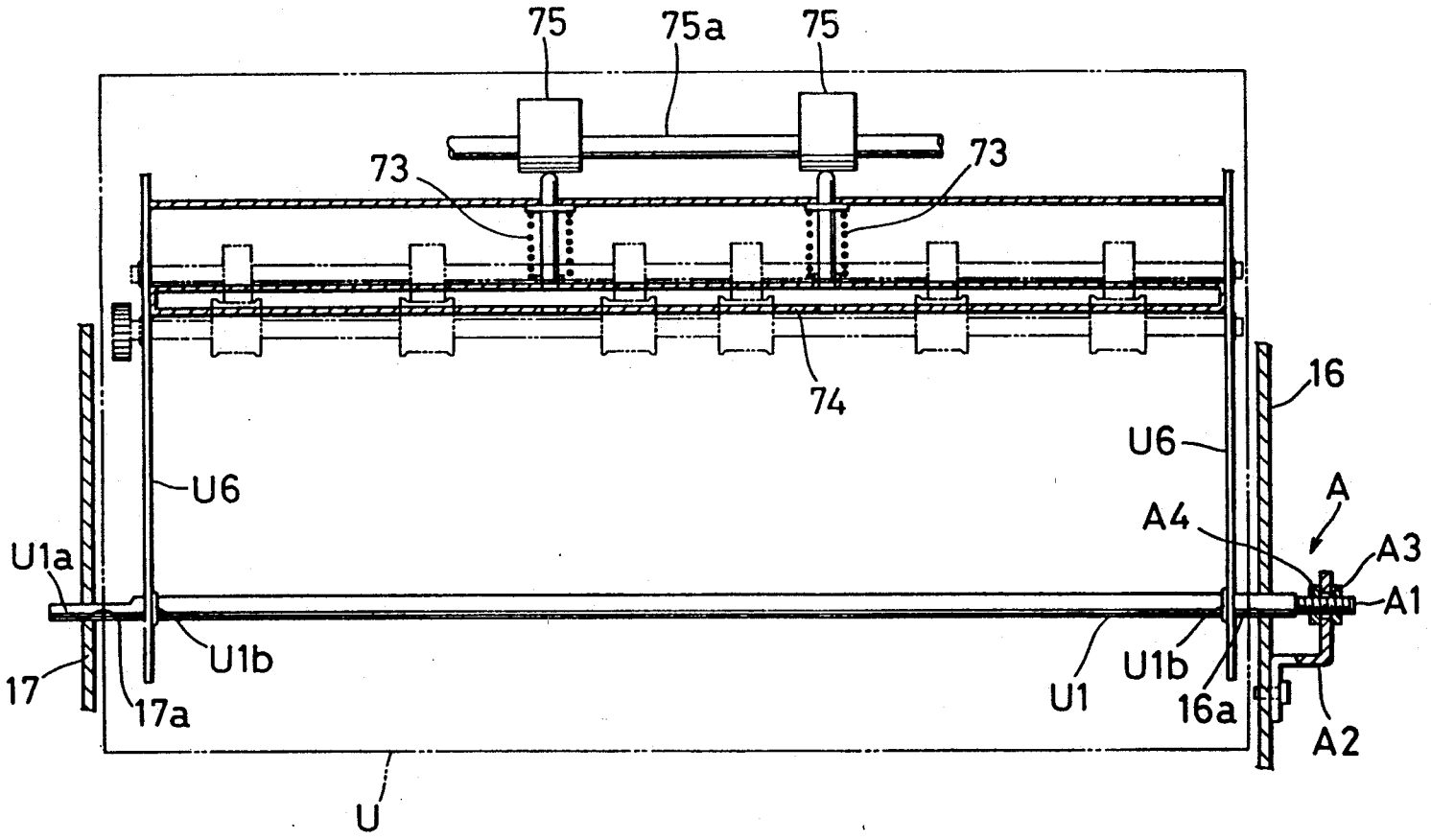
FIG. 22 is a sectional view of the unit in the embodiment of FIG. 21.
Figure 23:
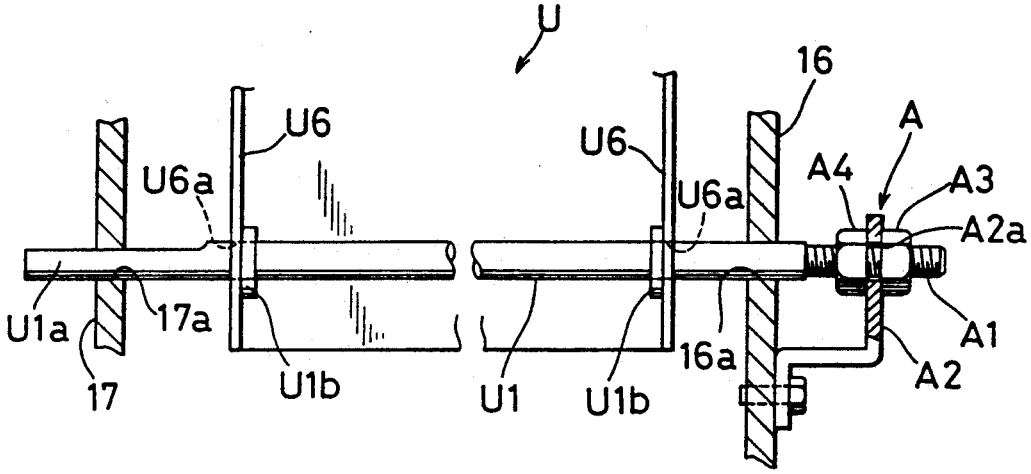
FIG. 23 is an enlarged sectional view showing the main portion of the unit.

As shown in FIGS. 21 to 23, the unit U provided in the electrostatic copying apparatus is movable in the width direction of the paper P. Furthermore, the unit U is provided with an adjustment means A for moving the unit U in the width direction of the paper P so as to adjust the position to punch holes in the paper P.

A shaft U1 for pivotably supporting the unit U in the casing 1 can slide and be inserted in through holes 16*a*, 17*a* which are provided in the side plates 16, 17 of a portion to house the unit U. One side end portion U1*a* of the shaft U1 is less than fully circular in a sectional view. This portion is inserted in a through hole 17*a* having the same sectional form, thereby to prevent the shaft U1 from rotating while allowing it to move in its longitudinal direction.

The unit U is pivotably supported by the shaft U1 which is pivotably inserted into through holes U6*a*. The through holes U6 are formed in the side plates U6 constituting the side portions of the unit U. The flanges U1*b* provided on the shaft U1 come in contact with the side plates U6, so as to prevent the unit U from sliding on the shaft U1. The unit U is pivotably supported by the shaft U1, while the unit U is movable in the width direction of the paper P along with the shaft U1 which slides in its longitudinal direction.

As seen in FIGS. 22 and 23, an adjustment means A for moving the shaft U1 in its longitudinal direction to shift the unit U in the width direction of the paper P includes;

a male threaded portion A1 formed at one end portion of the shaft U1;

a support metal fitting A2 provided with a through hole A2*a* and fastened to the side plate 16; and nuts A3, A4 fit on the male threaded portion A1 in such a manner as to hold the support metal fitting A2 between them.

In the adjustment means A, loosening of one nut A3, A4 while tightening the other nut A3, A4 moves the shaft U1 in the direction of the loosened nut A3, A4. As the shaft U1 moves, the unit U shifts, thereby to adjust the position to punch holes in the paper P.

Figure 24:
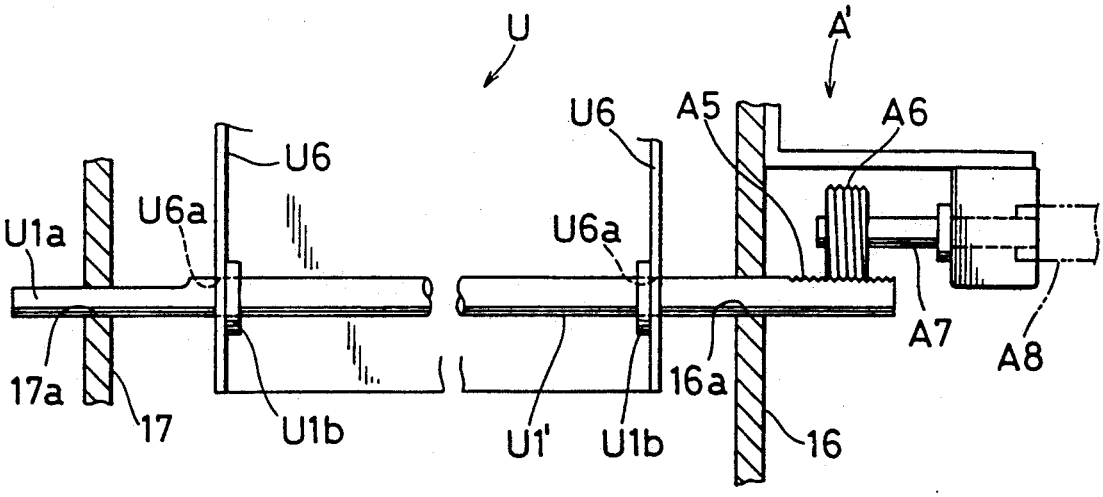
FIG. 24 is an enlarged sectional view showing a modification of an adjustment means for moving the unit.

FIG. 24 shows another example of the adjustment means A'.

The adjustment means A' includes inclined threads A5 formed on one end portion of the shaft U1', and a worm gear A6 to mesh with the inclined threads A5. The worm gear A6 is rotatably supported by a shaft A7 and is fixed in the vertical position.

In the adjustment means A', a handle A8, shown with a two-dot-and-dash line in FIG. 24 is attached to the shaft A7. Turning the worm gear A6 with the handle A8 will shift the shaft U1' in its longitudinal direction. Along with the turning shaft U1', the unit U moves, and thus the position to punch holes in the paper P can be adjusted.

In addition to the function wherein the phase of the cams 75 is varied to stagger the timing for the punching cutters 72 to punch holes, there may be suggested another function as shown, for instance, in FIGS. 25 to 30.

Figure 25:
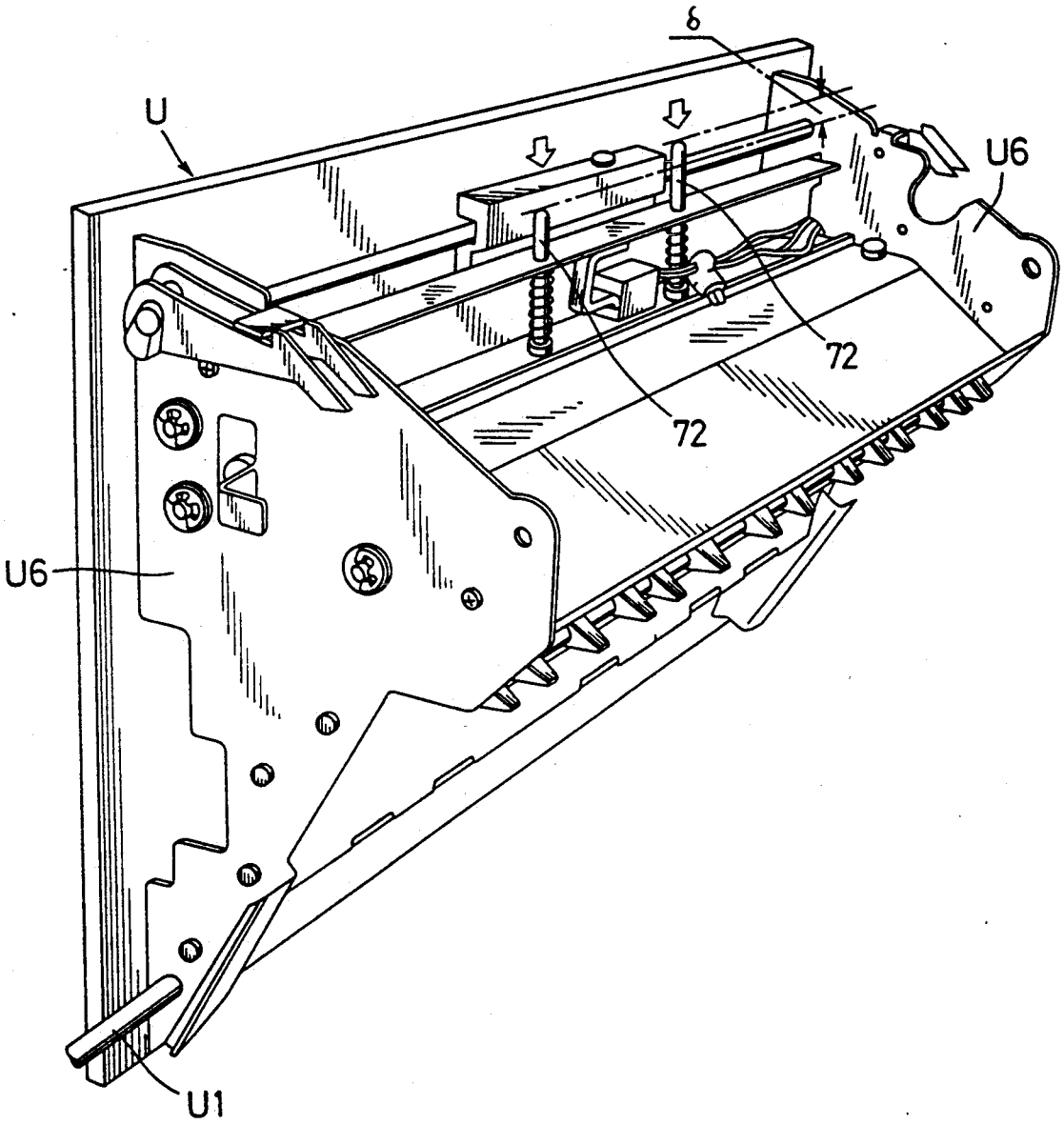
FIGS. 25 to 30 are perspective views showing modifications of a punching means provided with a function to delay timing to punch holes with punching cutters.

In FIG. 25, one of the punching cutters 72 is made longer than the other and is extends a length 'δ' higher than the other. When a pushing means (not shown) such as a pair of cams 75 of the same phase is brought into contact with the punching cutters 72 as shown with arrows in the FIG. 25, the longer punching cutter 72 comes in contact with the pushing means at first and is pressed downward to punch the first hole in the paper P. Then, the shorter punching cutter 72 comes in contact with the pushing means and is pressed downward so as to punch the other hole in the paper P.

When three or more holes are to be punched, a plurality of punching cutters 72 of different lengths may be used.

Figure 26:
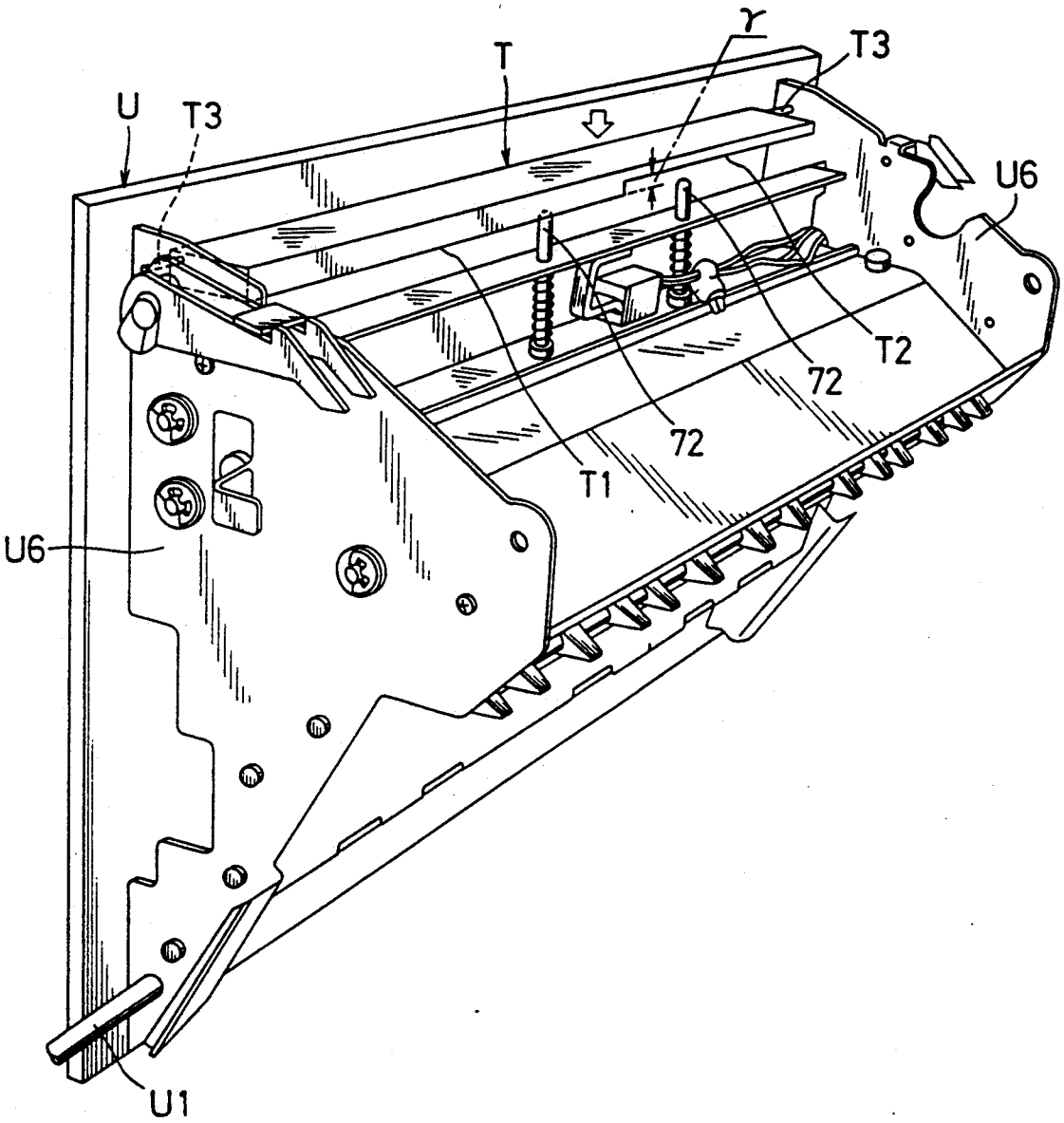

In FIG. 26, a spacer T for providing a time lag in the operation of the punching cutters 72 is provided above the top end of the punching cutters 72. The spacer T has two contact surfaces T1, T2 on the bottom side, which contact the punching cutters 72. These contact surfaces have different heights, one of which is 'δ' higher than the other. The spacer T is supported by a shaft T3 on the side plates U6 of the unit U. When the spacer T is pushed and turned pivoted by a punching means (not shown) such as a cam, the punching cutter 72 coming in contact with the contact surface T1, which has a greater height, and is pressed downward to punch the first hole. Then the punching cutter 72 comes in contact with the contact surface T2, having less height and is pressed downward, thereby to punch the other hole.

Since the spacer T needs only one cam 75 as a pushing means, the structure of the pushing means becomes simple. The spacer T has a further advantage that because the contact surfaces are large, the position of the punching cutters 72 can be changed as desired, thereby to properly set the interval between the punching cutters 72. In the case of punching three or more holes, contact surfaces of different heights may be provided on the bottom of the spacer T of a number corresponding to the number of punching cutters 72.

Figure 27:
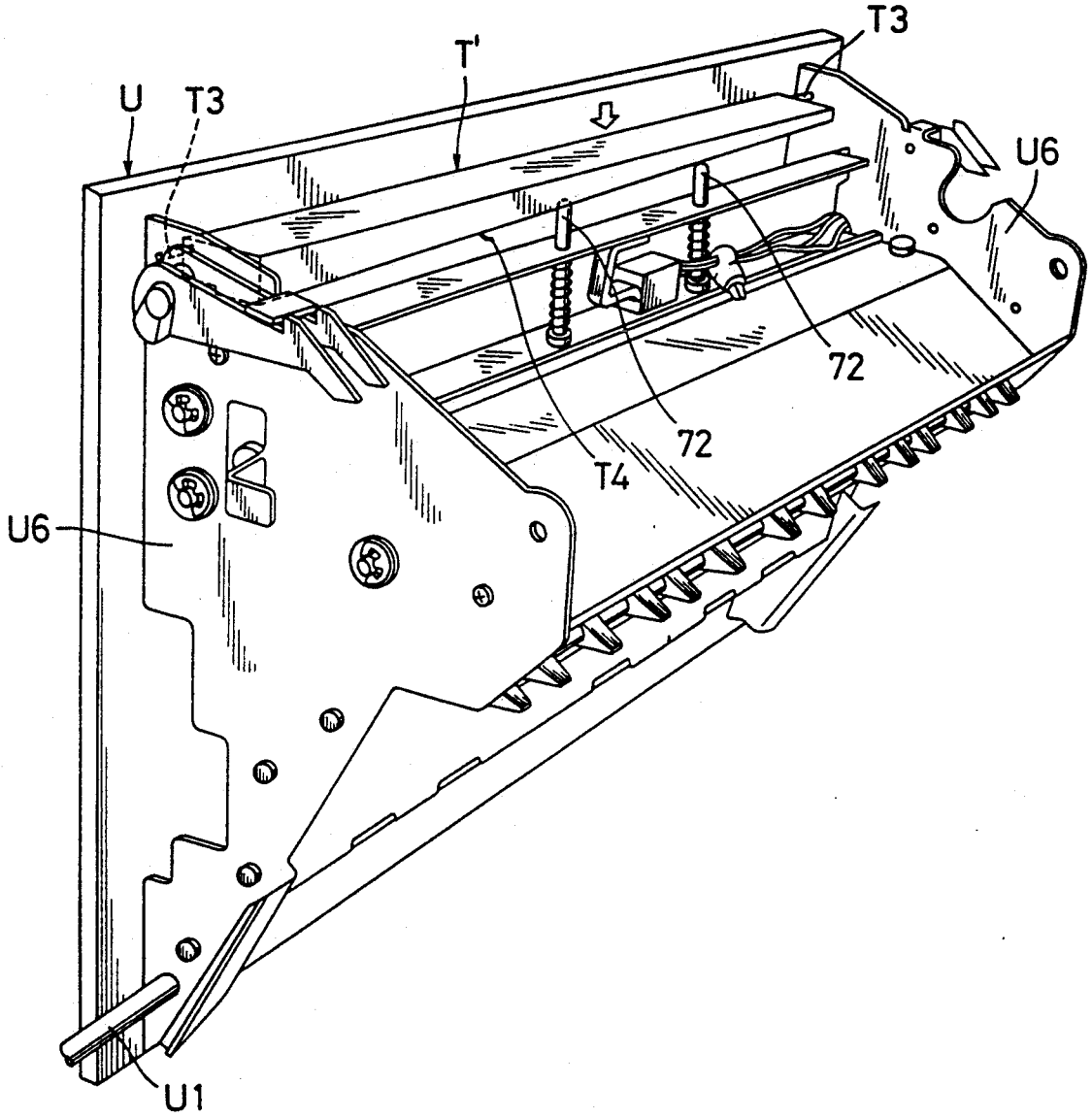

FIG. 27 shows an example like in FIG. 26, wherein a spacer T' for providing a time lag in the operation of the punching cutters 72 is provided above the top end of the punching cutters 72. The spacer T', like the above spacer T, is supported by the shaft T3 on the side plates U6 of the unit U. This spacer T' differs from the above spacer T in that the contact surface touching the punching cutters 72 is of one straight slanting surface, whose height gradually increases from the side plate U3 of the unit U to the side plate U4.

When the pushing means such as a cam 75 (not shown) presses the spacer T' to pivot it, as shown with an arrow in the FIG. 27, the punching cutter 72 coming in contact with the contact surface at a greater height is pressed downward to punch the first hole. Then the other punching cutter 72 comes in contact with the contact surface at less height and is pressed down and punches the second hole.

The spacer T' has a straight slanting contact surface T4 which comes in contact with the punching cutters 72. Setting a desired number of punching cutters 72 at desired positions can stagger timing for any of the punching cutter 72 to punch holes. Accordingly, the spacer T can advantageously allow setting of the number or the interval of holes, as desired.

Figure 28:
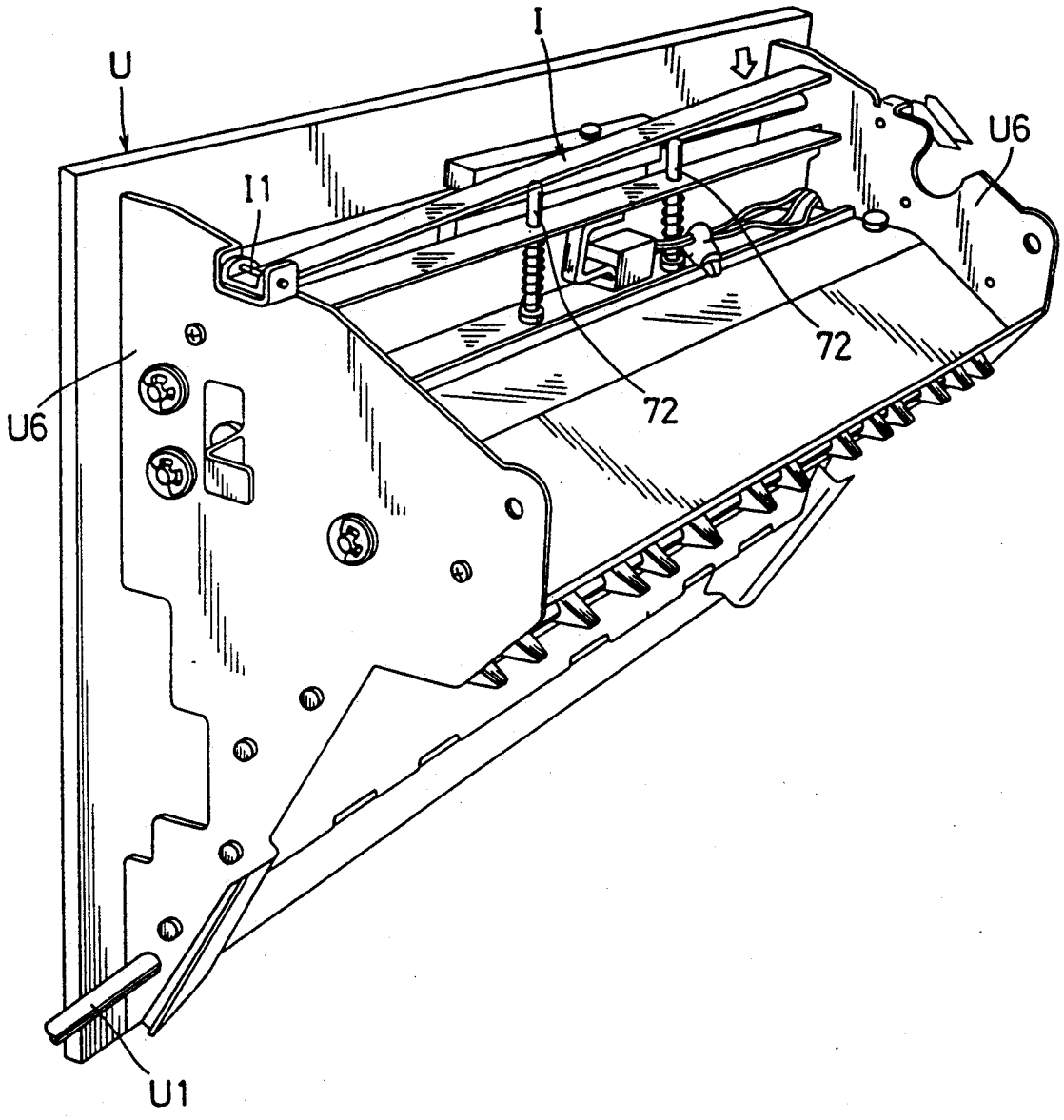

FIG. 28 shows an example, wherein instead of using the spacer T, one end of a plate I is pivotably supported by a shaft I1 disposed on one side plate U6 of the unit U, thereby to stagger timing to punch holes. When pushing means (not shown) pushes the plate I on the end opposite to the shaft I1, as shown with an arrow in FIG. 28, the punching cutter 72 nearer to the shaft I1 is at first pressed down by the plate I and punches the first hole. Then the punching cutter 72 farther from the shaft I1 is pressed down and punches the other hole.

Like FIG. 27, the plate I has an advantage that the number or the interval of holes can be set as desired, because pivoting the plate on the shaft I1 will make the punching cutters 72 punch holes sequentially from the one nearer to the shaft I1.

Figure 29:
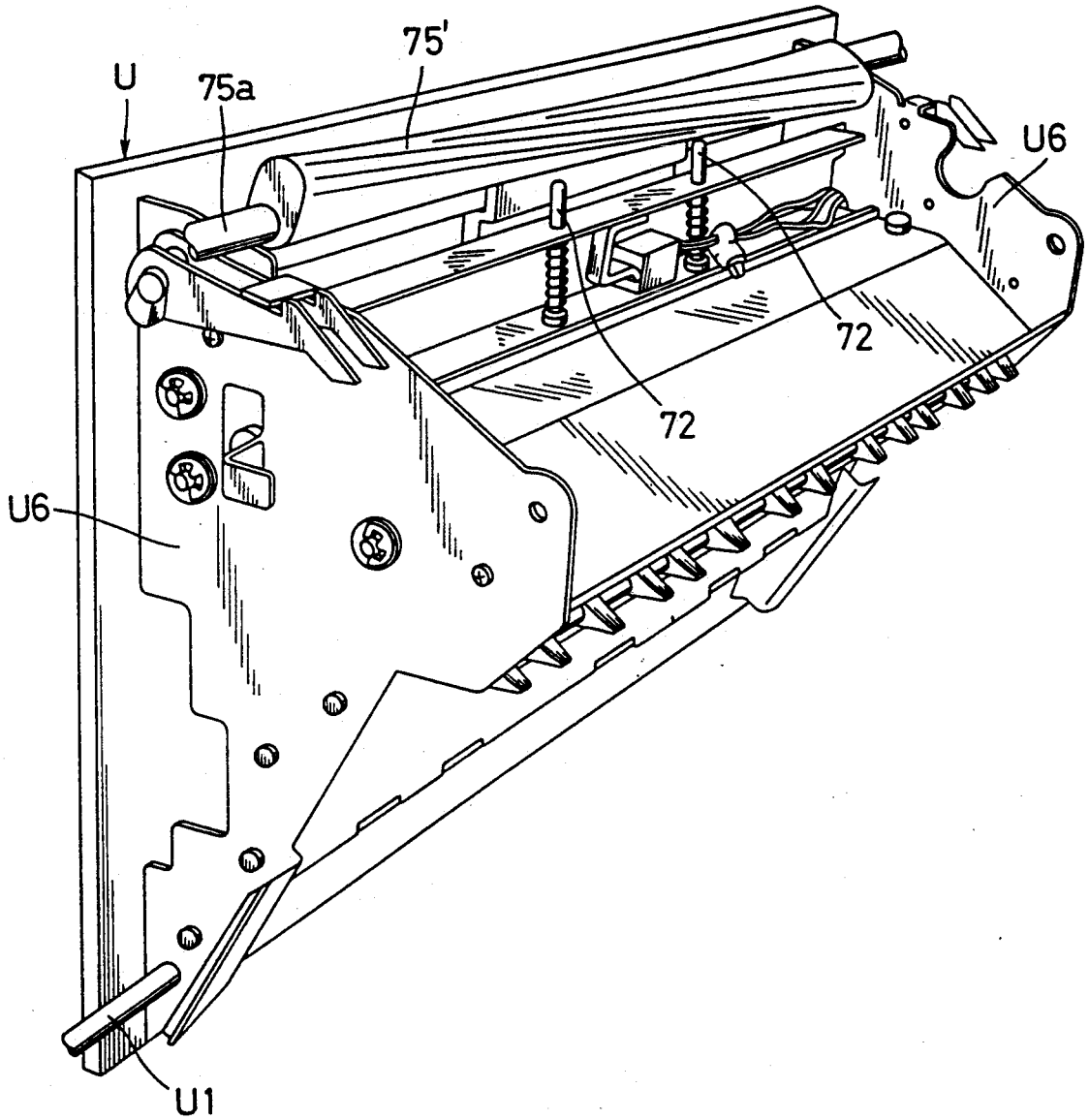

FIG. 29 shows an example which employs a cam 75' having a periphery gently twisted from one side plate U6 to the other side plate U6 of the unit U. When the cam 75' whose periphery is twisted, is pivoted by a shaft 75a, the punching cutter 72 coming in contact at first with the periphery is pressed down to punch the first hole. Then the cam 75' turns further and presses down the other punching cutter 72, thereby to punch the other hole.

When using the cam 75, the twisted periphery thereof sequentially comes in contact with the punching cutters disposed as desired, thereby to press down the punching cutters 72 one after another. Like FIGS. 27 and 28, the cam 75' has an advantage that the number and the interval of holes can be set as desired.

Figure 30:
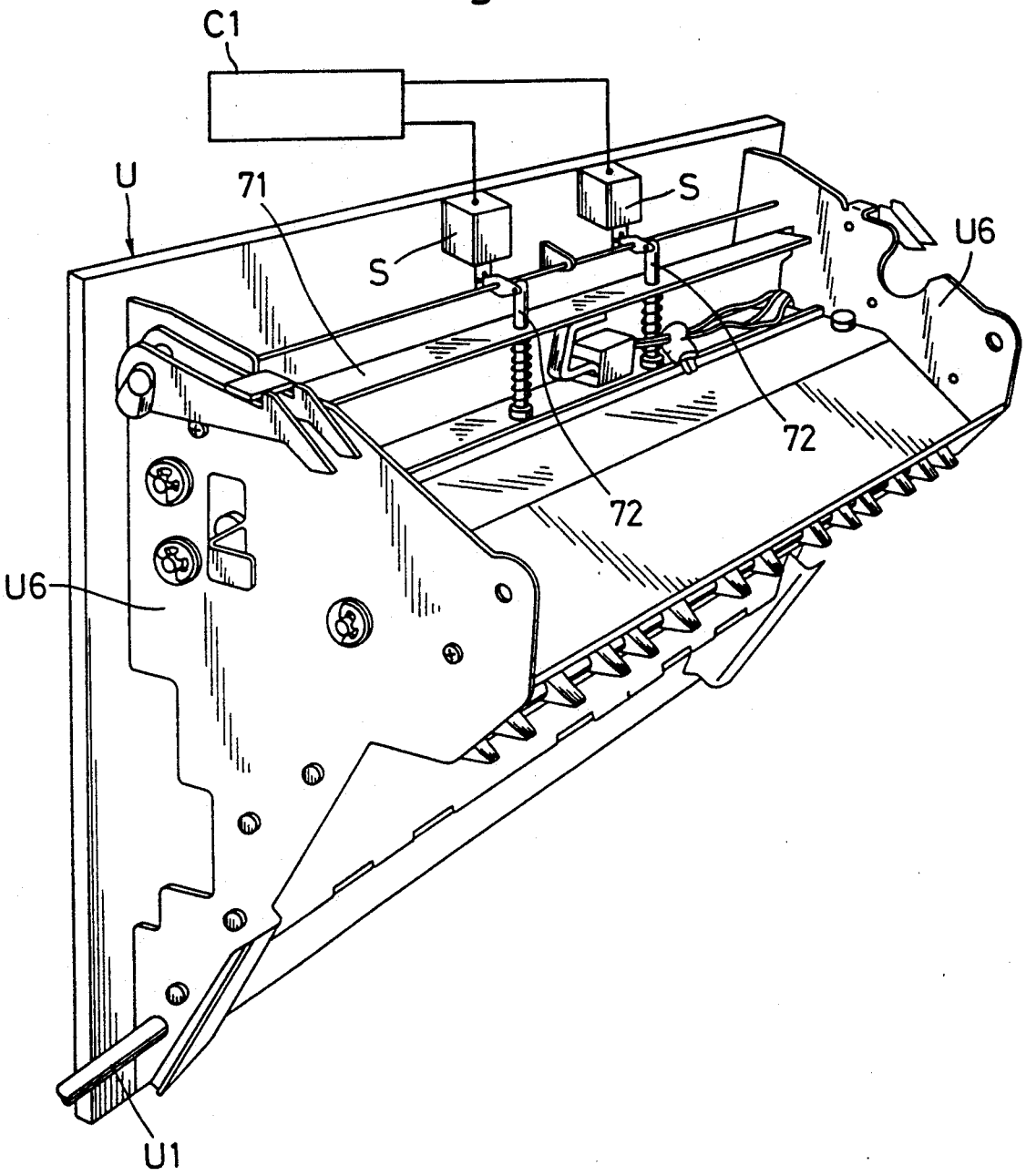

FIG. 30 shows an example wherein two solenoids S vertically move each of the punching cutters 72 separately. A differential control system delays operation timing for each of the solenoids S, thereby to electrically delay timing to punch holes.

Since this construction provides solenoids S for each punching cutter, the number and the interval of holes can be set as desired. In addition, the differential control system can advantageously vary the delay in the operation timing of each solenoid S as desired.

Figure 31:
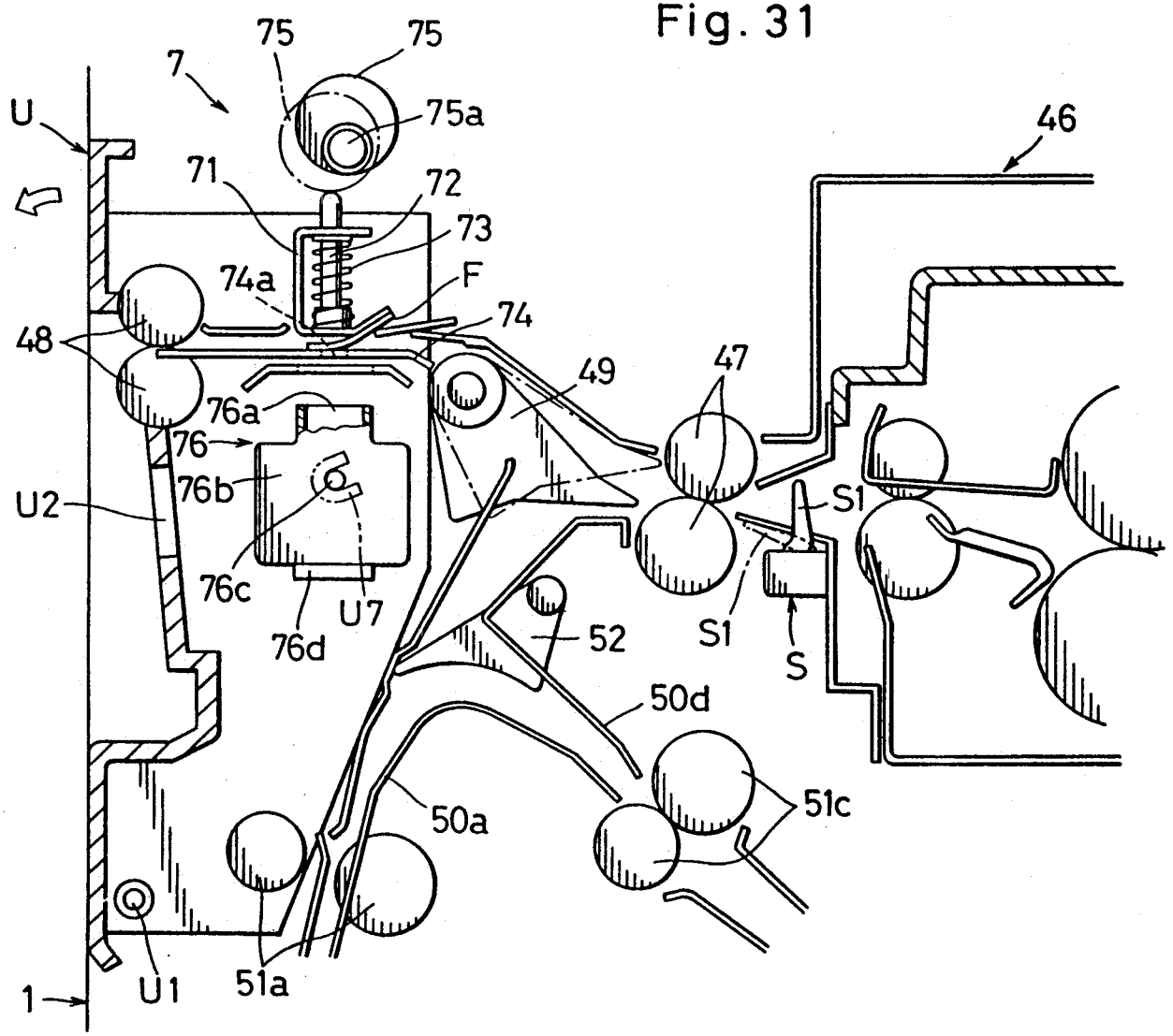
FIGS. 31 and 32 are sectional views illustrating the main portion of an embodiment wherein a box for collecting paper scraps is turnably supported in the unit.
Figure 32:
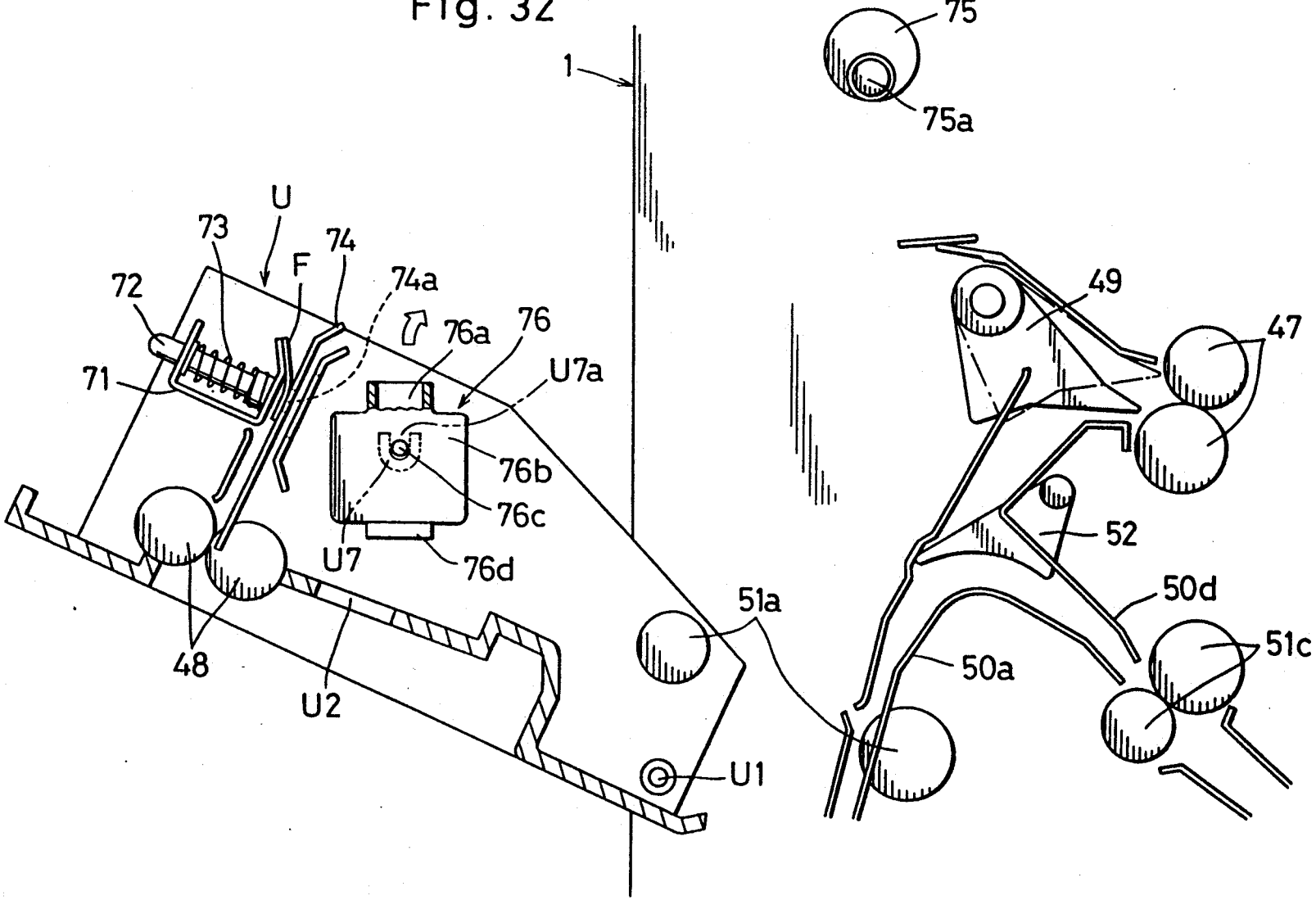

As shown in FIGS. 31 and 32, the collecting box 76 for collecting paper scraps P1 (see FIG. 9) made after the punching cutters 72 punch holes, may be pivotably supported so that an opening 76a for receiving the paper scraps P1 always faces upward.

Figure 33:
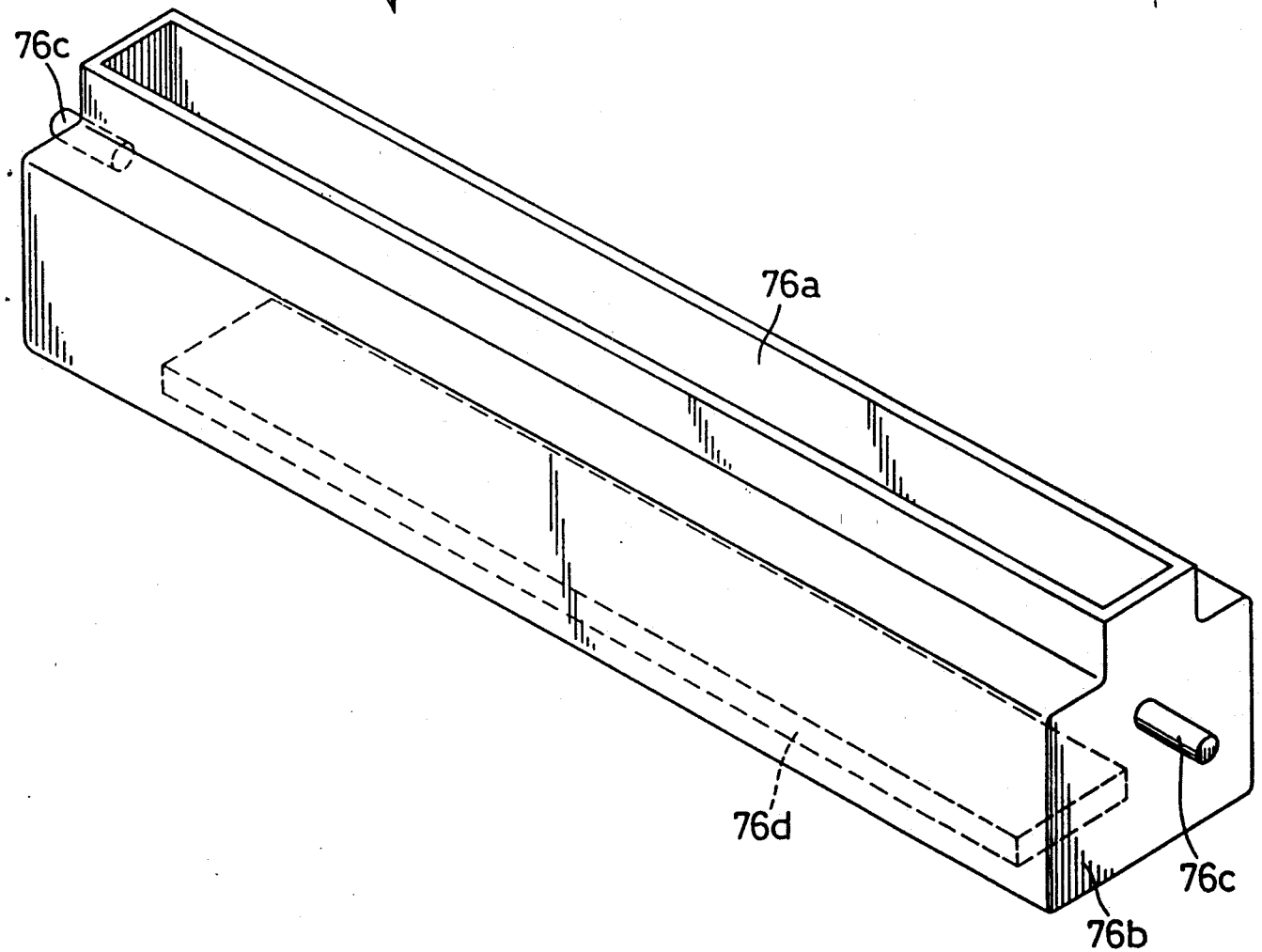
FIG. 33 is a perspective view of the collecting box used in the embodiment.

As shown in FIGS. 31 to 33, the collecting box 76 comprises a main body 76b with its opening 76a turned upward, support shafts 76c, 76c protruding from both sides of the main body 76b, and a weight 76d fixed to the bottom of the main body 76b. To allow checking the amount of paper scraps stored within the collecting box 76, the main body 76b is wholly made of transparent synthetic resin material. As shown with a two-dot-and-dash line in FIGS. 31 and 32, the support shafts 76c, 76c are turnably hooked to metal fittings U7 provided on the side walls of the unit U, thereby to pivotably support the collecting box 76. The weight 76d helps position the gravity center of the collecting box 76 near the bottom of the main body 76b and causes the collecting box 76 to pivot, keeping balance with the pivoting of the unit U, so as to maintain the opening 76a of the collecting box 76 upward.

For detaching the collecting box 76 from the unit U, as shown with an arrow in FIG. 32, an opening U7a, to let the support shaft 76c pass through, is provided in the metal fitting U7, which pivotably supports the support shaft 76c.

When the unit U is turned for the purpose of jam recovery or removal of paper scraps P1, the main body 76b of the collecting box 76 turns on the support shaft 76c, keeping balance to the movement of the unit U, thereby maintaining the opening 76a always facing upward. Thus paper scraps P1 are prevented from falling out from the collecting box 76.

Figure 34:
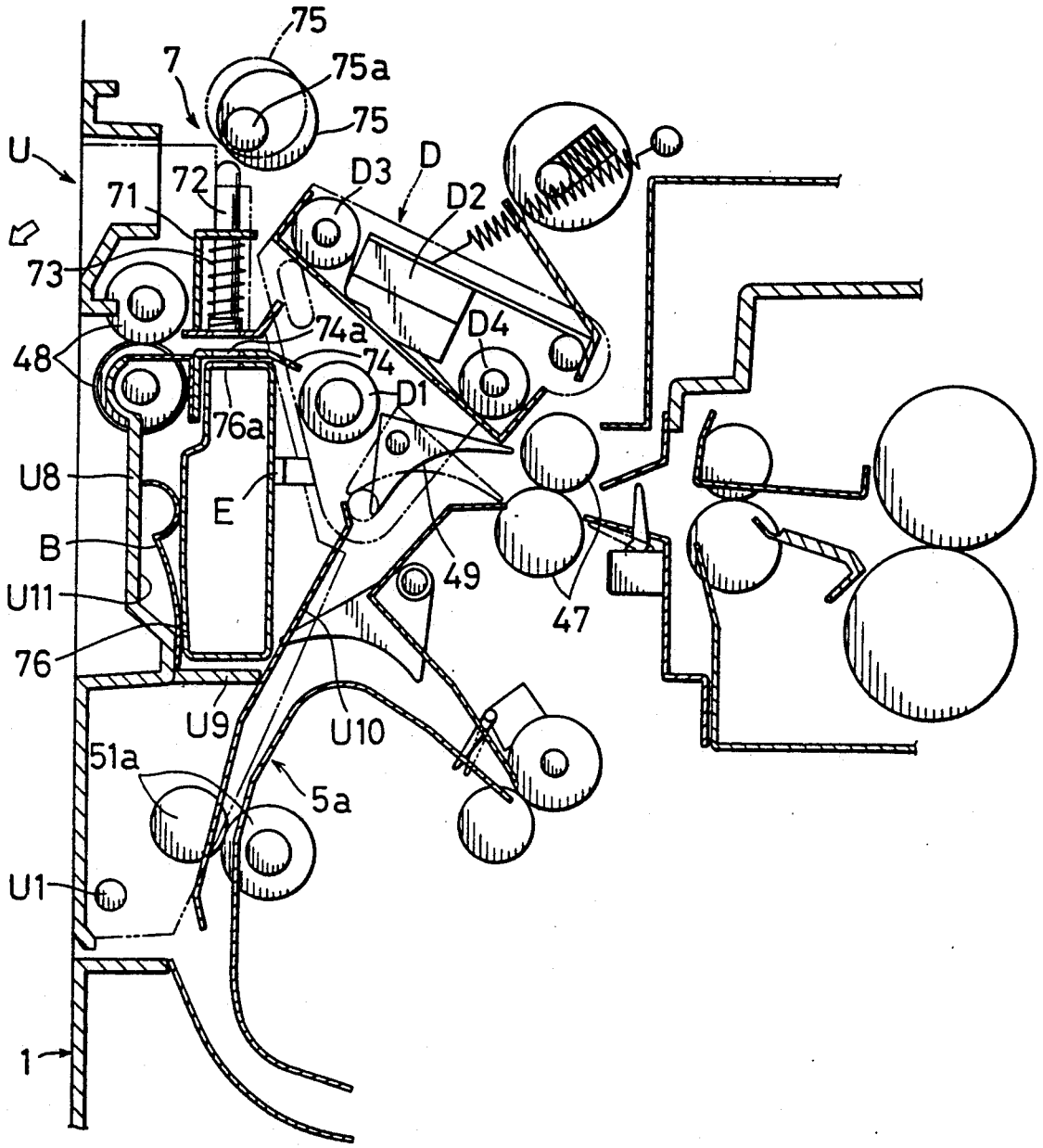
FIGS. 34 and 35 are sectional views showing the main portion of an embodiment provided with a function to lift up the collecting box with an elastic member.
Figure 35:
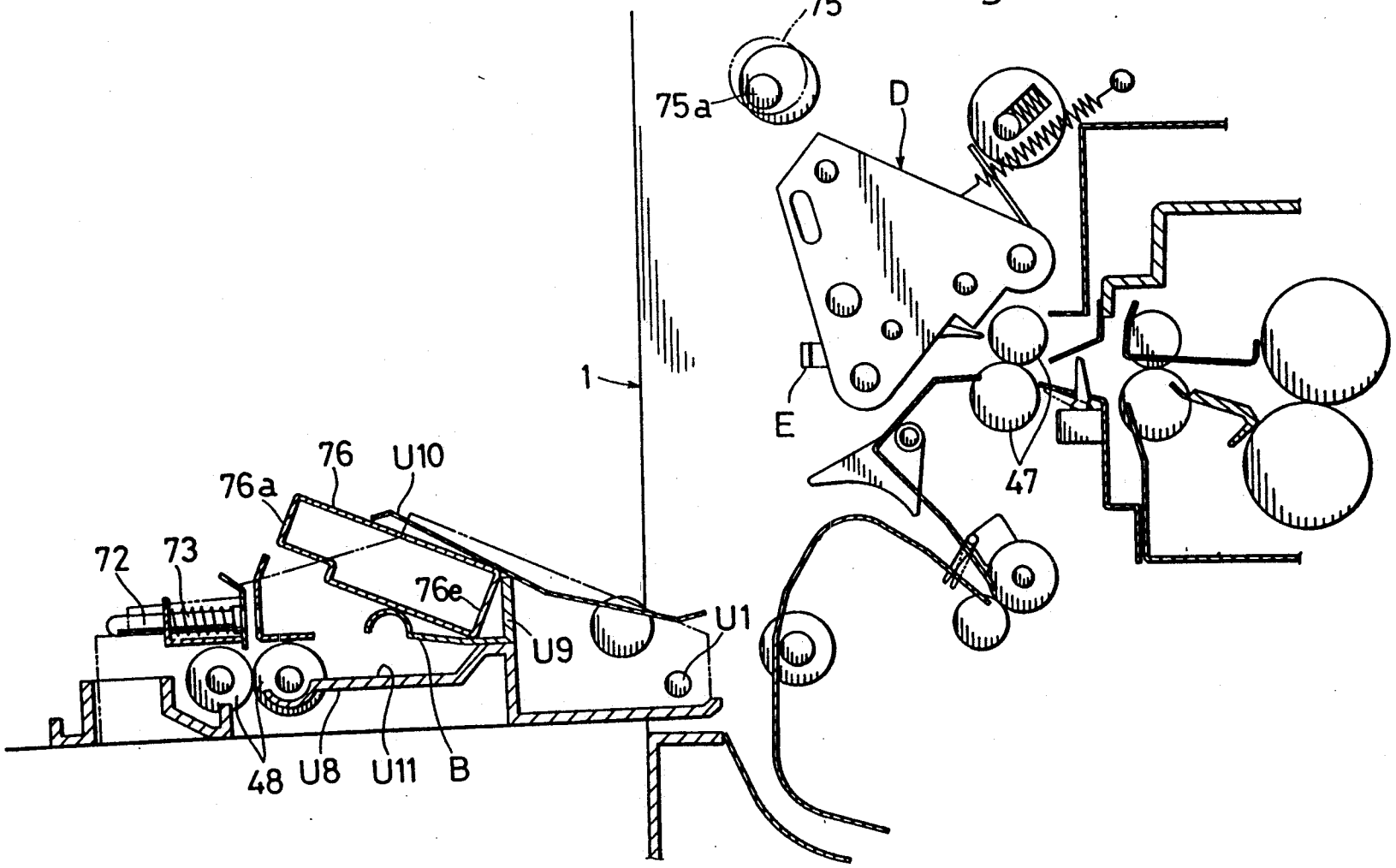

For the function of preventing paper scraps P1 from falling out from the collecting box 76, a plate spring B, as an elastic member, shown in FIGS. 34 and 35 may be used so as to lift up the opening 76a side of the collecting box 76. In the FIGS. 34 and 35, the collecting box 76 is housed in a retaining portion U11 covered by a front-side plate U8, a bottom plate U9 and a back-side plate U10 of the unit U. The plate spring B is disposed between the front-side plate U8 and the collecting box 76 in the retaining portion U11. The side of the back-side plate U10 which is adjacent the collecting box bottom end 76e is disposed close to the bottom of the collecting box 76, so that the bottom end 76e of the collecting box 76, is not also lifted up when the plate spring lifts up the opening end 76a of the collecting box, as shown in FIG. 35. Not to hamper the opening 76a side from being lifted up, this back-side plate U10 is slanted, being farther from the collecting box 76 on the opening side 76a.

As shown in FIG. 34, the casing 1 is provided with a pressure projection E as a pressing member. This projection E presses the collecting box 76 toward the front-side plate U8 against the elastic stress of the plate spring B, while the unit U is pressed within the casing 1. The opening 76a of the collecting box 76 is pressed toward the front-side plate U8 by the pressure projection E, and thus corresponds with the through hole 74a in the punching die 74 of the punching means 7, thereby to collect paper scraps P1. The pressure projection E comprises a metal plate having a sponge affixed to the surface touching the collecting box 76, so as to prevent damage on the surface of the collecting box 76.

Figure 36:
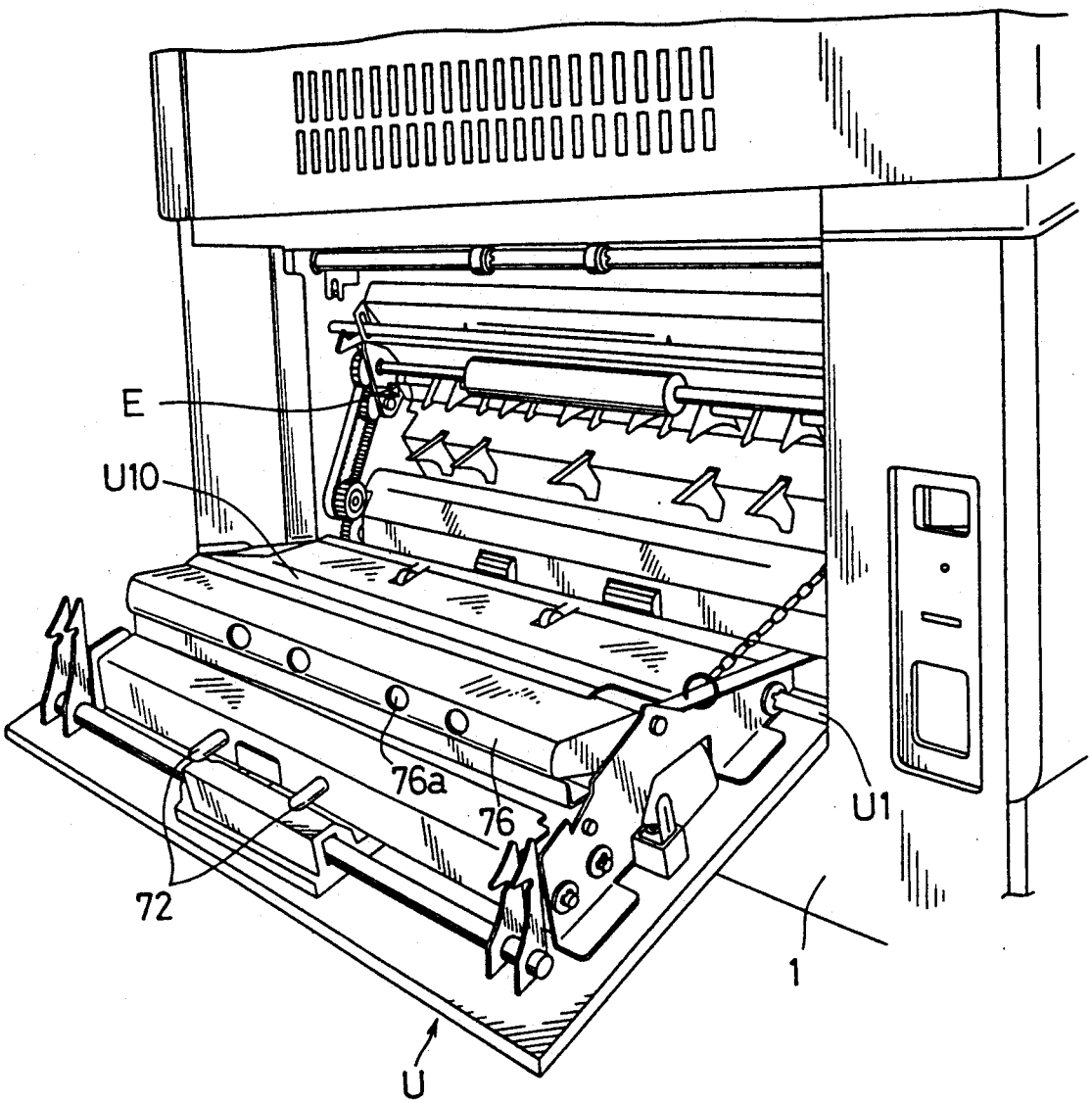
FIG. 36 is a perspective view showing a state when the unit is turned and drawn out of the casing in this embodiment.
Figure 37:
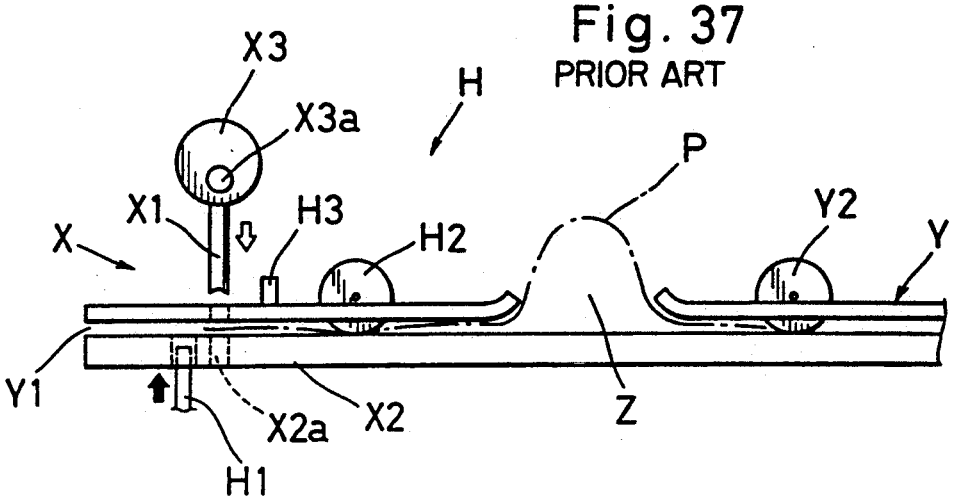
Fig. 37 PRIOR ART
FIGS. 37 to 41 are sectional views showing conventional examples.
Figure 38:
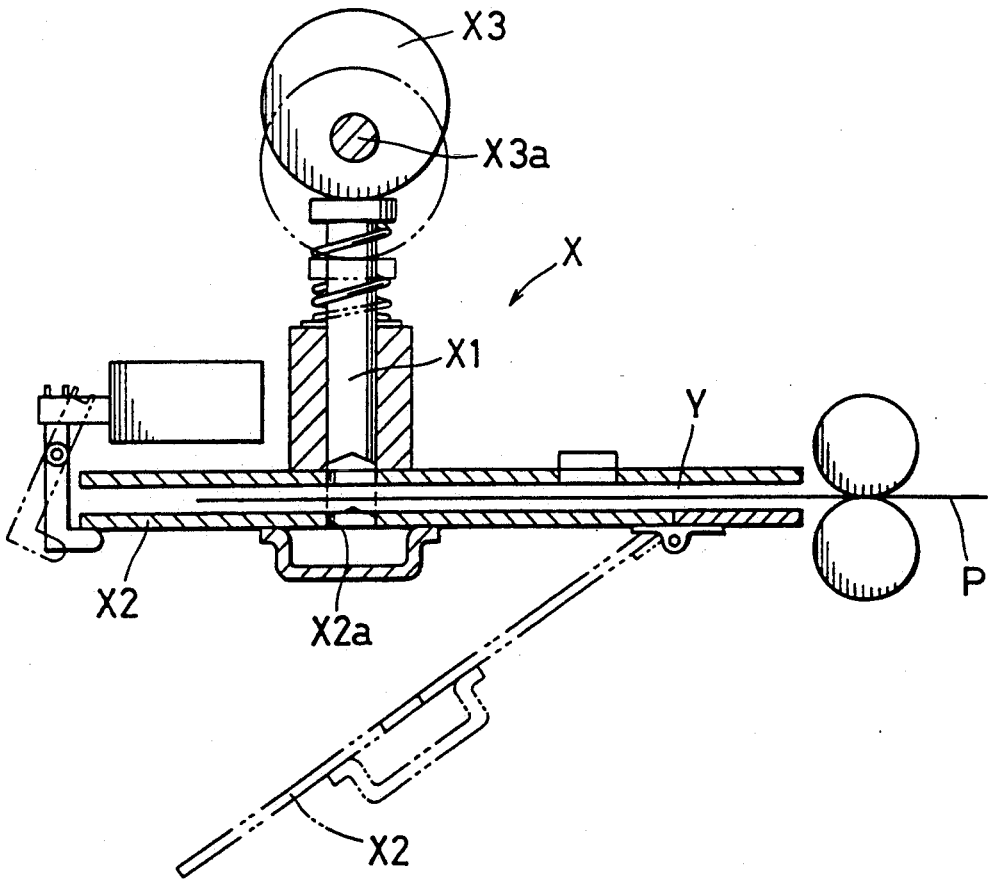
Fig. 38 PRIOR ART
Figure 39:
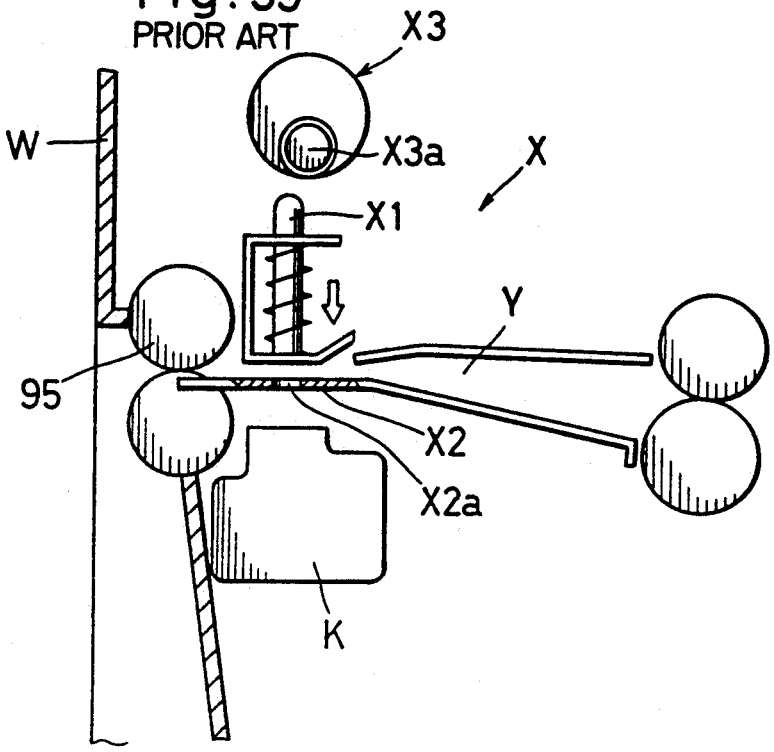
Fig. 39 PRIOR ART
Figure 40:
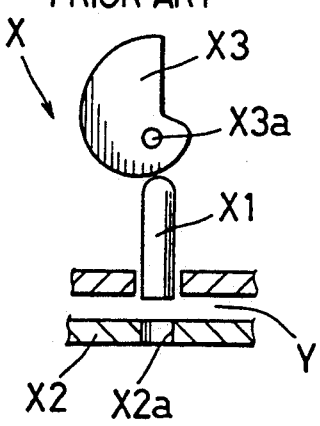
Fig. 40 PRIOR ART
Figure 41:
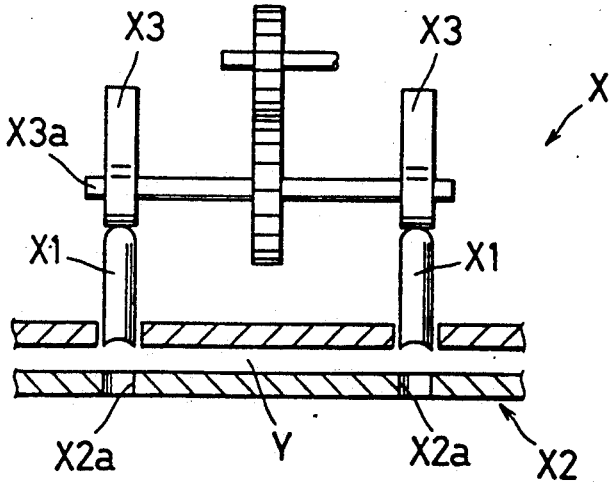
Fig. 41 PRIOR ART

When the unit U is pivoted and drawn out of the casing 1, as shown in FIGS. 35 and 36, the collecting box 76 is not pressed by the pressure projection E. Hence, the collecting box 76 is raised up by the elastic stress of the plate spring B, and its opening 76a is pivoted upward. Therefore, the paper scraps P1 are prevented from falling out from the opening 76a.

In the electrostatic copying apparatus in FIG. 34, an added data printing device D is provided between the delivery rollers 47 of the first paper delivery portion 4 and the punching means 7. The added data printing device D comprises;

a platen roller D1 for supporting the paper P from below;

a thermal head D2 which can move up and down in the direction of the platen roller D1;

and reels D3, D4 for feeding thermal ribbon to the thermal head D2. The added data printing device D is used to print added data such as a page number or date at a predetermined position on the paper P whereon an image has been formed.

It is understood that the structure of an image forming apparatus according to the present invention should not be limited to the above embodiments.

For example, the embodiment in the drawings uses the sensor S disposed in the paper delivery portion 4 as a detecting means. As the detecting means, there can be provided such a means as to judge the length of the paper P from previously inputted paper size data such as the kind of paper cassette 13a, 13b to feed the paper P and the like, and to execute a arithmetic processing to calculate and detect the position of the trailing portion of the paper P, namely, the distance from the trailing edge of the paper P to the punching means 7. The detecting means is incorporated into a drive control means for controlling the operation of the electrostatic copying apparatus. The data of the distance from the trailing edge of the paper P to the punching means 7, which is detected by the detecting means, is inputted as data of a predetermined pulse count or data of a predetermined period of time for setting timing to temporarily halt the paper P. The data is used when the drive control means controls the discharge rollers 48.

The drive control means may detect the leading edge of the paper P, to control the rotating of the discharge rollers 48 according to the relationship between the signal and the length of the paper P, and to stop temporarily the paper P with the trailing portion thereof on the punching means.

In the above-mentioned embodiments, the unit U is pivoted around the turning shaft and is drawn out of the casing 1. The unit U may be moved parallel on rails and be drawn out of the casing 1.

Each embodiment uses the discharge rollers 48 as a discharge means. However, the discharge means may be composed of a belt.

In each embodiment, the upper and the lower guide plates composing the guide passage 7a for the paper P are also used as the supporter 71 of the punching cutter 72 and as the punching die 74 respectively. These upper and lower guide plates may be separate from these members.

The function of pivoting the collecting box 76, keeping balance with pivoting of the unit may not necessarily be done with the support shafts 76c and the weight 76d. For example, there may be adopted a function wherein pivoting of the unit in the casing 1 is transmitted through a gear or belt to the support shaft of the collecting box 76, thereby to mechanically turn the collecting box 76.

The arrangement of a discharge roller 48, punching means 7, collecting box 76 and the like may be properly altered in the unit U. The punching means 7 may be disposed in an other casing which is externally attached to the casing 1 which houses the optical system 2, image forming portion 3, the first and second paper delivery portion 4, 5, the intermediate tray 6 and such.

The embodiment in the drawings shows an electrostatic copying apparatus as an example of an image forming apparatus. The composition according to the present invention may be applied to other image forming apparatus such as a laser beam printer.

What is claimed is:

1. A hole punch for punching holes in paper delivered from an image forming apparatus said hole punch comprising:

punching means including a plurality of punching cutters disposed at a predetermined interval in the width direction of the paper, a punching die for receiving said punching cutters, and pushing means for pushing said punching cutters toward said punching die; and a plurality of paper holders formed of a thin elastic plate and having leading edges elastically pressed on said punching die to guide the paper to said punching die.

2. A hole punch for punching holes in paper delivered from an image forming apparatus, said hole punch comprising:

punching means including a plurality of punching cutters disposed at a predetermined interval in the width direction of the paper, a punching die for receiving said punching cutters, and pushing means for individually pushing said punching cutters toward said punching die while timing the pushing of individual ones of said plurality of punching cutters to vary the timing of the punching of individual ones of the holes; and a plurality of paper holders formed of a thin elastic plate and having leading edges elastically pressed on said punching die to guide the paper to said punching die.

3. A hole punch according to claim 2, wherein said pushing means includes a rotatable shaft, and cam means mounted on said shaft for rotation therewith to press down each punching cutter in sequence, thereby to vary the timing for each punching cutter to punch a hole.

4. A hole punch according to claim 3 wherein:

said cam means comprises a plurality of cam members equal in number to the number of punching cutters, said cam members being attached to said rotary shaft with respective varied phases, so as to vary the timing for pushing of the corresponding punching cutters to punch holes in the paper.

5. A hole punch according to claim 3, wherein said cam means comprises an elongated cam member gently twisted in the width direction of paper.

6. A hole punch according to claim 3 wherein:

said punching cutters are rods, each rod having an axis directed in the pushing direction of said cam means; and the axis of said rotatable shaft is horizontally displaced from the axis of said punching cutters.

7. A hole punch according to claim 2, wherein said plurality of punching cutters have different lengths, and wherein said pushing means comprises a plurality of cams, one cam corresponding to each respective punching cutter, and a rotatable shaft having said plurality of cams mounted thereon in the same phase, so that timing for the respective punching cutters to punch holes is varied in accordance with the punching cutter lengths.

8. A hole punch according to claim 2, wherein said pushing means comprises means for pressing down said plurality of punching cutters sequentially, thereby causing each punching cutter in sequence to punch a hole.

9. A hole punch according to claim 8, wherein said pressing means comprises a spacer bar having contact surfaces of different heights, said contact surfaces corresponding to the respective punching cutters.

10. A hole punch according to claim 8, wherein said pressing means comprises a spacer bar having a slanted contact surface for contacting each punching cutter in sequence.

11. A hole punch according to claim 8, wherein said pressing means comprises an elongated plate, means for pivotably mounting one end of said elongated plate, and means for pushing down the other end of said elongated plate, thereby to sequentially press down said punching cutters commencing from the punching cutter nearest said one end of said elongated plate.

12. A hole punch according to claim 2 wherein:

said pushing means comprises a plurality of solenoids for respectively moving said plurality of punching cutters up and down; and means for controlling the operation timing of said solenoids to vary the timing for each punching cutter to punch a hole.

13. A hole punch according to claim 2 wherein:

said punching means further includes a supporter for supporting said punching cutters, said supporter including a lower horizontal plate and an upper horizontal plate disposed above said lower horizontal plate; and each punching cutter includes a flange adapted to contact the bottom surface of the upper horizontal plate when said pushing means is not pushing said punching cutter toward said punching die, so as to limit the rising of said punching cutter with the cutting edge thereof positioned slightly above the bottom surface of said lower horizontal plate.

14. A hole punch according to claim 13, wherein said punching die and said lower horizontal plate cooperate to serve as guide plates of a guide passage for guiding the paper.

15. A hole punch according to claim 2, wherein said punching means further includes a plurality of levers for lifting up said plurality of punching cutters.

16. A hole punch according to claim 2 further comprising:

discharge means for discharging the paper;

detecting means for detecting the leading or the trailing edge of the paper; and drive control means responsive to said detecting means for controlling said discharge means to halt said discharge means with the trailing portion of the paper at said punching means for punching of holes therein, and after said punching means has punched the holes in the trailing portion for restarting said discharge means so that the paper with the holes punched therein is discharged.

17. A hole punch according to claim 2 further comprising:

a casing supporting said pushing means and covering said punching means; and a unit member within said casing and housing said punching cutters and said punching die and adapted to be drawn out of said casing to separate said punching cutters from said pushing means.

18. A hole punch for punching holes in paper delivered from an image forming apparatus, said hole punch comprising:

a casing;

a unit member pivotably mounted on said casing and pivotable to a position withdrawn from said casing;

punching means within said unit member and including a plurality of punching cutters disposed at a predetermined interval in the width direction of the paper, a punching die for receiving said punching cutters and a collecting box having an opening thereinto at an upper portion thereof and disposed under said punching die to receive through the opening paper scraps made by punching holes in the paper and to store the paper scraps therein; and means on said unit member for maintaining the opening of said collecting box facing upward as said unit member is pivoted.

19. A hole punch according to claim 18, wherein:

said collecting box includes support means pivotably supporting said collecting box in said unit member; and said means for maintaining the opening of said collecting box facing upward comprises means for pivoting said collecting box.

20. A hole punch according to claim 19, wherein:

said support means comprises a support shaft extending from said collecting box, said collecting box being pivotably supported on said unit member by said support shaft; and said means for maintaining the opening of said collecting box facing upward comprises a weight connected to said collecting box below said support shaft.

21. A hole punch according to claim 18, wherein:

said maintaining means comprises an elastic member for lifting up the side of the collecting box having the opening therethrough as said unit member is pivoted; and said casing includes a pressing member for pressing said collecting box against the elastic bias of said elastic member as said unit member is pressed in said casing, thereby positioning the opening of said collecting box beneath said punching die.

22. An image forming apparatus according to claim 18, wherein said unit member has a window for checking the amount of paper scraps contained in said collecting box.

23. A hole punch according to claim 22, further comprising a transparent plate in the window.

24. A hole punch according to claim 22, wherein the window comprises a plurality of slits.

25. A hole punch according to claim 18, wherein:

said punching means further includes a rotatable shaft supported in said casing, and a cam mounted on said shaft to rotate therewith and push said punching cutters toward said punching die.

26. A hole punch for punching holes in paper delivered from an image forming apparatus, said hole punch comprising:

punching means including a plurality of punching cutters disposed at a predetermined interval in the width direction of the paper, a punching die for receiving said punching cutters, pushing means for pushing said punching cutters toward said punching die; and a plurality of paper holders formed of a thin elastic plate and having leading edges elastically pressed on said punching die to guide the paper to said punching die;

a casing covering said punching means and supporting said pushing means; and a unit member within said casing and housing said punching cutters and said punching die and adapted to be drawn out of said casing to separate said punching cutters from said pushing means.

27. A hole punch for punching holes in paper delivered from an image forming apparatus, said hole punch comprising:

punching means including a plurality of punching cutters disposed at a predetermined interval in the width direction of the paper, a punching die for receiving said punching cutters, and pushing means for pushing said punching cutters toward said punching die;

a casing covering said punching means;

a unit member housing said punching cutters and said punching die while permitting said punching cutters and said punching die to be drawn out of said casing to separate said punching cutters from said pushing means, said unit member including a shaft pivotably mounting said unit member in said casing, while permitting said unit member to be drawn out of said casing; and adjustment means for adjusting the position of said unit member in the width direction of the paper thereby to adjust the position in the width direction of the paper at which said punching means punches holes in the paper, said adjustment means including means for moving said shaft in the width direction of the paper, thereby to move said unit member in the width direction of the paper.

28. A hole punch according to claim 27, wherein said adjustment means is includes a side plate (16) of said casing.

29. A hole punch according to claim 27, wherein said pushing means comprises a rotatable shaft, and a cam mounted on said rotatable shaft for rotation therewith.

30. A hole punch according to claim 27, further comprising a collecting box mounted under said punching die and in said unit member, said collecting box having an opening thereinto permitting said collecting box to receive paper scraps made by punching holes in the paper and to store the paper scraps therein.

31. A hole punch for use with an image forming apparatus, said hole punch comprising:

detecting means for detecting the leading or the trailing edge of a paper as the paper is delivered by paper delivery means of the image forming apparatus;

punching means for punching holes in the paper;

discharge means for discharging the paper; and drive control means responsive to said detecting means for controlling said discharge means to halt said discharge means with the trailing portion of the paper at said punching means, for controlling said punching means to punch holes in the paper adjacent the trailing edge thereof with respect to the paper delivery direction, and after said punching means has punched the holes for restarting said discharge means so that the paper with holes punched therein is discharged, said drive control means including a timer responsive to a signal from said detecting means for halting said discharge means after a predetermined period of time, said timer including an adjustment means for adjusting the predetermined period of time, thereby altering the position of the punched holes in the longitudinal direction of the paper.

32. A hole punch according to claim 31, wherein said discharge means comprises a pair of discharge rollers.

33. A hole punch according to claim 31, wherein said discharge means includes a drive system separate from a drive system of the image forming apparatus.

34. A hole punch according to claim 31, wherein said discharge means includes:

an electromagnetic clutch for coupling said discharge means to the drive system of the image forming apparatus; and a control system responsive to signals from said detecting means for controlling said electromagnetic clutch.

35. A hole punch according to claim 31, wherein said detecting means includes a sensor provided with a detecting arm adapted to fall down on touching the leading edge of a paper delivered by the paper delivery means and to stand up when the trailing edge of the paper passes.

36. A hole punch according to claim 35, wherein said detecting means further includes jam detecting means responsive to said detecting arm not standing up for a predetermined period of time after said detecting arm has fallen down, for detecting a paper jam.

37. A hole punch according to claim 31, wherein:

said punching means includes a plurality of punching cutters disposed at a predetermined interval in the width direction of the paper, a punching die for receiving said punching cutters; and pushing means for pushing said plurality of punching cutters separately towards said punching die to punch holes at times shifted for each separate punching cutter.

38. A hole punch according to claim 31, wherein:

said punching means includes a plurality of punching cutters disposed at a predetermined interval in the width direction of the paper, a punching die for receiving said punching cutters, a casing covering said punching cutters and punching die and permitting said punching cutters and said punching die to be drawn out of said casing, and adjustment means for adjusting the position of said punching cutters and punching die in the width direction of the paper, thereby to adjust the position in the width direction of the paper at which said punching means punches holes in the paper.

39. A hole punch for use with an image forming apparatus, said hole punch comprising:

detecting means for detecting the leading or the trailing edge of a paper as the paper is delivered by paper delivery means of the image forming apparatus;

punching means for punching holes in the paper;

discharge means for discharging the paper; and drive control means responsive to said detecting means for controlling said discharge means to halt said discharge means with the trailing portion of the paper at said punching means, for controlling said punching means to punch holes in the paper adjacent the trailing edge thereof with respect to the paper delivery direction, and after said punching means has punched the holes for restarting said discharge means so that the paper with holes punched therein is discharged, said drive control means including a rotation member, a pulse generator for converting the rotation of said rotation member into pulses, and a pulse counter for counting the pulses and providing a signal upon counting of a predetermined number of pulses to halt said discharge means, said pulse counter including adjustment means for adjusting the predetermined number of pulses to adjust the timing of the halt of said discharge means, thereby altering the position of the punched holes in the longitudinal direction of the paper.

40. A hole punch for use with an image forming apparatus, said hole punch comprising:

detecting means for detecting the leading or the trailing edge of a paper as the paper is delivered by paper delivery means of the image forming apparatus;

punching means for punching holes in the paper, said punching means including a plurality of punching cutters disposed at a predetermined interval in the width direction of the paper, a punching die for receiving said punching cutters, and pushing means for pushing said punching cutters toward said punching die;

a casing for supporting said pushing means and covering said punching means;

a unit member within said casing and housing said punching cutters and said punching die and adapted to be drawn out of said casing to separate said punching cutters from said pushing means said unit member including pivotable mounting means pivotably mounting said unit member to said casing; a collecting box mounted under said punching die and in said unit member, said collecting box having an opening thereinto permitting said collecting box to receive paper scraps therein; and means for causing the opening of said collecting box always to face upward as said unit member is pivoted;

discharge means for discharging the paper; and drive control means responsive to said detecting means for controlling said discharge means to halt said discharge means with the trailing portion of the paper at said punching means, for controlling said punching means to punch holes in the paper adjacent the trailing edge thereof with respect to the paper delivery direction, and after said punching means has punched the holes for restarting said discharge means so that the paper with holes punched therein is discharged.

41. A hole punch for punching holes in paper delivered from an image forming apparatus, said hole punch comprising:

punching means including a plurality of punching cutters disposed at a predetermined interval in the width direction of the paper, a punching die for receiving said punching cutters, and pushing means for pushing said punching cutters toward said punching die;

a casing covering said punching means and supporting said pushing means; and a unit member within said casing and housing said punching cutters and said punching die and adapted to be drawn out of said casing to separate said punching cutters from said pushing means;

discharge means within said unit member for discharging the paper; and a collecting box mounted under said punching die and in said unit member, said collecting box having an opening thereinto permitting said collecting box to receive paper scraps made by punching holes in the paper and to store the paper scraps therein; said unit member including a main unit portion pivotably mounted on said casing and including said punching cutters, said punching die, and a first discharge roller; and a sub unit portion pivotably mounted on said main unit portion and including said collecting box and a second discharge roller, said first and second discharge rollers cooperating to form said discharge means.

42. A hole punch according to claim 41, wherein said pushing means comprises a rotatable shaft, and a cam mounted on said shaft for rotation therewith.

43. A hole punch according to claim 41, wherein:

each punching cutter comprises a rod having a longitudinal axis directed in the pushing direction of said pushing means; and the axis of said rotatable shaft is horizontally displaced from the longitudinal axis of the punching cutters.

44. A hole punch according to claim 41, wherein:

said punching means further includes a supporter for supporting said punching cutters and including a lower horizontal plate and an upper horizontal plate disposed above said lower horizontal plate, and each punching cutter is provided with a flange adapted to contact the bottom surface of said upper horizontal plate when said pushing means is not pushing said punching cutter toward said punching die, so as to limit upward movement of said punching cutter with the cutting edge thereof positioned slightly above the bottom surface of said lower horizontal plate.

45. A hole punch according to claim 44, wherein said punching die and said lower horizontal plate cooperate to serve as guide plates of a guide passage for guiding the paper into the hole punch.

46. A hole punch according to claim 41, wherein said punching means further includes a plurality of levers for lifting up said plurality of punching cutters.

47. A hole punch according to claim 41, wherein said punching means further includes means delaying the pushing of individual ones of said plurality of punching cutters to delay the timing of the punching of individual ones of the holes.

48. A hole punch according to claim 41, further comprising:

detecting means for detecting the leading or the trailing edge of the paper; and drive control means responsive to said detecting means for controlling said discharge means to halt said discharge means with the trailing portion of the paper at said punching means for punching of holes therein, and after said punching means has punched the holes in the trailing portion for restarting said discharge means so that the paper with the holes punched therein is discharged.

49. A hole punch for punching holes in paper delivered from an image forming apparatus, said hole punch comprising:

punching means including a plurality of punching cutters disposed at a predetermined interval in the width direction of the paper, a punching die for receiving said punching cutters, and pushing means for pushing said punching cutters toward said punching die;

a casing covering said punching means and supporting said pushing means; and a unit member within said casing and housing said punching cutters and said punching die and adapted to be drawn out of said casing to separate said punching cutters from said pushing means;

discharge means within said unit member for discharging the paper; and a collecting box mounted under said punching die and in said unit member, said collecting box having an opening thereinto permitting said collecting box to receive paper scraps made by punching holes in the paper and to store the paper scraps therein;

said unit member including a main unit portion pivotably mounted on said casing and including said punching cutters and said punching die; and a sub unit portion pivotably mounted on said main unit portion and including said collecting box and said discharge means.

50. A hole punch for punching holes in paper delivered from an image forming apparatus, said hole punch comprising:

punching means including a plurality of punching cutters disposed at a predetermined interval in the width direction of the paper, a punching die for receiving said punching cutters, and pushing means for pushing said punching cutters toward said punching die;

a casing covering said punching means and supporting said pushing means;

a unit member within said casing and housing said punching cutters and said punching die and adapted to be drawn out of said casing to separate said punching cutters from said pushing means;

means mounting said unit member on said casing while permitting said unit member to be drawn out of said casing, said mounting means comprising a shaft pivotably mounting said unit member in said casing and permitting said unit member to be pivoted and drawn out of said casing; and adjustment means for adjusting the position of said unit member in the width direction of the paper, thereby to adjust the position at which said punching means punches holes in the paper, said adjustment means comprising means for moving said shaft in the width direction of the paper, thereby to move said unit member in the width direction of the paper.

51. A hole punch for punching holes in paper delivered from an image forming apparatus, said hole punch comprising:

punching means including a plurality of punching cutters disposed at a predetermined interval in the width direction of the paper, a punching die for receiving said punching cutters, and pushing means for pushing said punching cutters toward said punching die;

a casing covering said punching means and supporting said pushing means; and a unit member within said casing and housing said punching cutters and said punching die and adapted to be drawn out of said casing to separate said punching cutters from said pushing means, said unit member including a collecting box mounted under said punching die and having an opening thereinto permitting said collecting box to receive paper scraps made by punching holes in the paper and to store the paper scraps therein;

means pivotably mounting said unit member on said casing, to permit said unit member to be drawn out from said casing by pivoting of said unit member; and means for maintaining the opening of said collecting box facing upward as said unit member is pivoted.

52. A hole punch according to claim 51 wherein:

said collecting box includes means pivotably supporting said collecting box in said unit member; and said means for maintaining the opening of said collecting box facing upward includes means for pivoting said collecting box.

53. A hole punch according to claim 51 wherein:

said means for maintaining the opening of said collecting box facing upward comprises an elastic member which lifts up the side of said collecting box having the opening therethrough as said unit member is pivoted; and said casing includes a pressing member for pressing said collecting box against the elastic bias of said elastic member as said unit member is pressed in said casing, thereby positioning the opening of said collecting box beneath said punching die.

* * * * *